US006079631A

United States Patent [19]

Ortwein et al.

[11] Patent Number: 6,079,631

[45] **Date of Patent: *Jun. 27, 2000**

[54] RAIL-FASTENING ASSEMBLY

[75] Inventors: Hermann J. Ortwein, Muhlenweg 25, D-51588 Numrecht, Germany; David Ronald Seeley, Herford, United Kingdom; Stephen John Cox, Richmond, United Kingdom; Kenneth George Allen, Grays, United Kingdom; Brian George Conroy; Martin David Somerset, both of Worksop, United Kingdom; Peter William Brindley, Dinnington, United Kingdom; Andrew Garwood, Sheffield, United Kingdom

[73] Assignees: Pandrol Limited, Addlestone, United Kingdom; Hermann J. Ortwein, Numrecht, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/737,193

[22] PCT Filed: Mar. 6, 1996

[86] PCT No.: PCT/GB95/00510

§ 371 Date: Dec. 5, 1996

§ 102(e) Date: Dec. 5, 1996

[87] PCT Pub. No.: WO96/27709

PCT Pub. Date: Sep. 12, 1996

[30] Foreign Application Priority Data

Mar. 6, 1995 [GB] United Kingdom ..... 9504424

[51] Int. Cl.[7] ..... E01B 9/44

[52] U.S. Cl. ..... 238/283; 238/382

[58] Field of Search ..... 238/264, 280, 238/283, 292, 336, 338, 342, 310, 382

[56] References Cited

U.S. PATENT DOCUMENTS 3,358,927 12/1967 Hein et al. ..... 238/283
3,387,781 6/1968 Moses et al. ..... 238/283

(List continued on next page.)

FOREIGN PATENT DOCUMENTS 0180118 8/1988 European Pat. Off. .
0432357 6/1991 European Pat. Off. .

(List continued on next page.)

OTHER PUBLICATIONS

Brochure titled "*Die Flüsterchiene. Whisper rail.*" (4 pages) by Krupp Lonrho GmbH of Essen, Germany (date unknown).

*Primary Examiner*—S. Joseph Morano
*Attorney, Agent, or Firm*—Gottlieb, Rackman & Reisman, P.C.; Norbert P. Holler; Allen I. Rubenstein

[57] ABSTRACT

A railway rail support assembly (3), for resiliently suspending a railway rail (1) above a track foundation (2) at discrete locations along the rail (1), has rail supporting means through which a predetermined clamping load is exerted on the said rail (1) such that the assembly (3) has a desired resistance to longitudinal creep therethrough of the rail (1). The rail supporting means are preferably attached, when the assembly (3) is in use, to an approximately horizontal upper surface of the said track foundation (2). Such an assembly (3) may be provided by first and second brackets (31, 32) and first and second elastic members (33, 34). Each of the said first and second brackets (31, 32) has a bearing part (312, 322) and a base part (311, 321) (311, 321), the bearing part (312, 322) being located adjacent to either sides of the rail (1) when the assembly (3) is in use and the base part (311, 321) being located on an upper surface of the said track foundation (2). The first elastic member (33) is located between the first bracket (31) and the rail (1) and the second elastic member (34) is located between the rail (1) and the second bracket (32), when the assembly (3) is in use. The assembly (3) further comprises means for maintaining the said predetermined clamping load.

33 Claims, 24 Drawing Sheets

U.S. PATENT DOCUMENTS

| | | | |
|---|---|---|---|
| 3,417,922 | 12/1968 | Vaulry | 238/283 |
| 3,525,472 | 8/1970 | Sato | 238/382 |
| 4,775,103 | 10/1988 | Ortwein | 238/283 |
| 4,793,545 | 12/1988 | Raymond | 238/8 |
| 5,165,598 | 11/1992 | Ortwein | 238/283 |

FOREIGN PATENT DOCUMENTS

| | | | |
|---|---|---|---|
| 0620316 | 10/1994 | European Pat. Off. . | |
| 0672790 | 9/1995 | European Pat. Off. . | |
| 1178883 | 10/1964 | Germany . | |
| 2000006 | 7/1971 | Germany . | |
| 2828713 | 1/1980 | Germany . | |
| 3108532 | 9/1982 | Germany . | |
| 3334119 | 4/1985 | Germany . | |
| 3507235 | 9/1986 | Germany . | |
| 3834329 | 4/1989 | Germany . | |
| 4007937 | 9/1991 | Germany | 238/283 |
| 4233433 | 4/1994 | Germany . | |
| 4311452 | 5/1994 | Germany . | |
| 280411 | 2/1927 | United Kingdom . | |
| 281594 | 4/1927 | United Kingdom . | |
| 529192 | 5/1939 | United Kingdom . | |
| 1098567 | 12/1966 | United Kingdom . | |
| 1471868 | 4/1974 | United Kingdom . | |

RAIL-FASTENING ASSEMBLY

The present invention relates to a rail-fastening assembly.

Railway lines running through cities necessarily pass close to people's homes and offices. Most urban railways run with steel wheels on steel rails, a system which has greater inherent tendency than rubber wheeled road traffic to generate high dynamic forces which can lead to unacceptable levels of noise and vibration. It is, therefore, important that railway track structures are designed to minimize this potential problem. One possible solution would be to resiliently support the track and make the mass of the resiliently supported track structure as large as possible. Another possible solution would be to make the support stiffness as low as possible.

Increasing the track mass tends to be very expensive, because it means that supporting bridges must be made stronger, and that tunnels must have a larger bore to accommodate the extra mass, which is almost always provided as some form of concrete structure or slab.

Reducing the stiffness of a conventional rail support system, in which a resilient pad, or resilient baseplate, or a resiliently mounted sleeper is provided between the foot of the rail and the track foundation, is limited by the need to avoid unacceptable levels of lateral deflection of the rail head when lateral loads are applied thereto. In such systems, the largest vertical deflection which can be safely allowed is generally no greater than 2 or 3 millimetres.

In order to overcome this problem, it has been suggested that the rail could be suspended under its head on continuous rubber supports supported by metal brackets. Such a system allows larger vertical deflections of the rail to be safely accommodated, for example approximately 5 or 10 mm. Correspondingly large lateral rail head deflections do not occur, because the rail is supported much closer to the line of application of forces than on a conventional fastening. The rubber supports are held in position by rigid metal parts. The assembly is held together by the use of bolts passing through the web of the rail and through the brackets and rubber inserts. Such fixing requires the rail to be drilled at regular intervals. In alternative designs, the rail is again suspended on continuous rubber supports, but is located in a continuous concrete trough. The rail no longer needs to be drilled and the assembly is held in place in one design by plastic keys, and in another by clamping plates, which are bolted down into the trough and locate the rail in position.

The track support systems described have been conceived with the primary objective of reducing vibration transmitted through the track to a minimum. This results in two significant features of their design. Firstly, the rail is continuously supported, so that there is no variation in track support stiffness along the length of the rail—this is done with the intention of eliminating harmonic excitation as a wheel traverses the track. Secondly, the fastening is designed so as to have a low vertical stiffness, and for this reason any load applied to the elastic support elements is deliberately minimised, since the stiffness of the elastic elements generally increases as load is applied thereto. In one design, disclosed in EP-A-0620316, the position of the side supporting elements is adjustable laterally, with the aim of achieving correct rail alignment with minimum compression of the continuous elastic elements.

However, there are considerable practical difficulties in the installation and maintenance of the afore-mentioned prior art systems. In the first type of system, in which bolts pass through the rail, the rail must be pre-drilled, and the supporting plates attached thereto before the rail can be installed. On curved track the rail and each of the supports must be bent to the appropriate radius, and the rail drilled at appropriate locations. The opportunity for errors in the calculations required, and in the accurate bending of the components, is large. The continuous support of the rail in both types of system can make it difficult to achieve a satisfactory combination of uniform support characteristics and accurate line and level of the rail, since rail alignment is surveyed and corrected at discrete points along the rail. In the second type of system, a continuous trough must be provided which is sufficient to provide the correct track gauge. This is not always easily achieved, given other constraints on track design.

In both systems the rail is concealed and not easily accessed. This makes many of the routine maintenance procedures which are required on a railway track, for example inspection, changing of worn rails, repair of damaged rails, or replacement of rubber components, much more difficult than on a conventional non-resilient track fastening where all the components are easily seen and are easily accessible.

It is, therefore, desirable to provide a system for resiliently fastening a rail, in which the benefits of supporting the rail under its head can be achieved, but without the practical drawbacks of existing systems.

According to one aspect of the present invention there is provided a railway rail support assembly, for resiliently suspending a railway rail above a track foundation at discrete locations along the rail, wherein the assembly has rail supporting means through which a predetermined clamping load is exerted on the said rail such that the assembly has a desired resistance to longitudinal creep therethrough of the rail. Because the rail is not supported continuously along its length, but only at discrete locations, the volume of the elastic members and metal brackets required is reduced as compared to continuous support systems, and the assembly can therefore be produced more cheaply.

It should be noted that in the continuous support systems of the prior art resistance to longitudinal rail movements, a requirement of most rail fastening systems, arises only as a result of the large area of contact between the elastic supports and the rail, not because of any significant load applied to the rail through the elastic support. In designs using bolts located through the rail, the bolts obviously provide an ultimate limit to the amount of longitudinal creep that can occur. However, it is not desirable to rely on the bolts in this way, since such loading could cause failure thereof.

It had previously been thought that continuous support of the rail was necessary in order to achieve large deflections and so prevent large stresses which would occur at the edges of discrete assemblies. In addition, such continuous systems were believed to be necessary in order that harmonic excitation of the rail could avoided. However, the applicants have recognised that, at the levels of support stiffness for which the support system will generally be designed, the length of bending waves in the rail is sufficiently long that the apparent difference of track support stiffness at respective positions above such a discrete assembly and in mid-span between two adjacent such assemblies is very small. In addition, a discrete assembly embodying the present invention can be designed such that shaping of the elastic elements and support brackets, when viewed in a horizontal plane in a direction perpendicular to the axis of the rail, ensures that there is no abrupt transition between the support stiffness above an assembly and at mid-span. Any harmonic excitation due to variations in support stiffness along the length of the track is therefore inconsequentially small. So the good vibration reducing properties of a continuous support system can to a very great extent be retained in a discrete system embodying the present invention. As an additional consequence of the small change in support stiffness along the length of the track, there is no tendency for there to be increased rail stresses at the edge of discrete assemblies embodying the present invention.

Resistance to longitudinal rail movement in an assembly embodying the present invention is provided without the need for additional and separate rail anchors or fasteners. In this respect, because the volume of elastic support in a discrete system is reduced as compared to a continuous one, which would otherwise decrease the support stiffness, a lateral load can now be applied to the elastic elements in each discrete assembly without increasing the track stiffness per metre of track (track modulus) where such assemblies are used as compared to an equivalent continuously supported track. Indeed it is necessary to apply a clamping load in the discrete assembly in order to offset the decrease in contact area between the elastic support and rail. This clamping load, applied in a lateral direction, serves the same function as the vertical clamping load applied by the fasteners in conventional unsupported track, namely to limit longitudinal movements in continuously welded rail. Resistance to longitudinal rail movement can be further increased by shaping the elastic elements and support brackets in a discrete assembly when seen in plan view such that any rail movement causes the elastic elements to be drawn into a wedge.

Thus, all the primary requirements of a fastening system, that is to absorb rail forces, to maintain track gauge, and to limit longitudinal rail movements, can be realised in a discrete fastening system embodying the present invention in which the rail is supported under its head by elastic elements through which a clamping load is applied. In addition, electrical insulation between the rail and the support is provided when suitable elastic elements are used. Furthermore, the need to drill the rail or to mount the system in a trough can be eliminated. Moreover, since in a discrete assembly the rail is supported only at discrete intervals and the supporting brackets and elastic elements do not extend continuously along the length of the rail, the assembly is comparatively easy to inspect and maintain, especially when the assembly is mounted on a flush surface, that is when the rail supporting means are attached to an approximately horizontal upper surface of the track foundation. The relatively small lateral rail head deflections in this type of assembly when it is subjected to lateral load components, and the relatively large bearing area over which these lateral loads are distributed as compared to conventional fastening systems where flat bottomed rail is fastened at its foot, may also make it suitable for use even in situations where vibration attenuation is not a primary concern.

An assembly embodying the present invention may comprise first and second brackets and first and second elastic members, each of the said first and second brackets having a bearing part and a base part, the bearing part being located adjacent to either side of the rail when the assembly is in use and the base part being located on an upper surface of the said track foundation, the first elastic member being located between the first bracket and the rail and the second elastic member being located between the rail and the second bracket, when the assembly is in use, and further comprising means for maintaining the said predetermined clamping load.

In such an assembly the said first and second brackets may be held in place on the track foundation by fixing means, at least part of which are located through respective base parts of the brackets.

The lower part of one of the brackets may extend under the rail to the other bracket side, thereby providing a baseplate. Alternatively, the baseplate may be provided separately. Such a separate baseplate may be attached to the track foundation independently of the brackets.

In embodiments of the present invention the base part of each of the said first and second brackets may have an inclined lower surface, upper surfaces of the said base plate being correspondingly inclined. Alternatively, where one bracket is fixed and the other is not, the base part of the non-fixed bracket may have an inclined lower surface, the said base plate having a corresponding inclined upper surface.

In a preferred embodiment of the present invention the said track foundation or base plate may have an upstand, the assembly further comprising a wedge element shaped such that it fits between the upstand and the bearing part of an adjacent one of the said brackets when the assembly is in use so as to maintain a desired clamping load applied to said bracket. The base part of the bracket may be provided with a slot therethrough through which the said upstand protrudes, in which case the fit of the upstand in the slot may be such that it allows movement of the bracket relative to the upstand, such that insertion of the wedge element between the upstand and the bearing part of the said bracket drives the bracket away from the said upstand, whereby the said desired clamping load is applied to the said bracket. The bearing part of the bracket may have a projection extending towards the said upstand so as to define a space between opposing surfaces of the projection and upstand for receiving said wedge element. The wedge element may be installed substantially vertically or horizontally. When the assembly is in use the wedge element is preferably secured by means of a bolt passing thereinto.

In an alternative arrangement, part of the said fixing means projects above the base part of the bracket such that between such projecting part and the said bracket there is defined an aperture for receiving cooperating first and second wedge elements shaped so as to maintain a desired clamping load applied to the said bracket. Each of the first and second wedge elements may have a serrated face, which serrated faces interlock when the assembly is in use.

Alternatively, in an assembly embodying the present invention the clamping load maintaining means may comprise eccentric cam means.

Embodiments of the present invention may use identical first and second elastomeric members together with identical first and second brackets, in order to support the rail without inclination.

In an assembly embodying the present invention, a suitable grout layer may be located between the track foundation and one or both of the brackets to level the assembly, and to adjust the height thereof, when the assembly is in use.

Such a suitable grout layer may also be used to provide a required inclination for the rail. Alternatively, the required inclination may be provided by the use of non-identical first and second elastomeric members, or by use of non-identical brackets.

In embodiments of the present invention each of the said first and second brackets and/or each of the said first and second elastic members may be shaped such that the stiffness of the assembly varies, in a direction parallel to the longitudinal axis of the rail, such that it is greatest in the central region of the assembly.

In addition, or alternatively, each of the first and second brackets and/or each of the first and second elastic members may be shaped so as to augment the applied clamping load.

Other embodiments of the invention may be such that the height of the rail relative to the track foundation is adjustable. In some such embodiments the fixing means may be constructed and arranged so as to assist in locating the brackets supporting the rail at the desired height relative to the rail.

Other embodiments of the present invention may be provided with a wedge, inserted between one of the elastic members and its associated bracket. In addition, a support plate may be located between the said first bracket and the said first elastic member. In such an assembly, a rigid member may be located between the support plate and the first bracket.

Embodiments of the present invention may include brackets which are hinged relative to the track foundation.

Embodiments of the present invention may include fixing means which comprise a shoulder and securing clip.

Such a securing clip may be held in place in the said shoulder by the resilience of that securing clip, the securing clip being substantially rigid in a vertical direction when the assembly is in use.

One example of securing clip comprises a front part which is inserted into the said shoulder when the assembly is in use, and a rear part to which force is applied in order to insert the said front part into the said shoulder, the said front part having means for retaining the clip in the shoulder when the assembly is in use.

Such a clip may comprise a front part having a pair of substantially parallel elongate members, and a rear part having a curved member joining the two elongate members, one of the said elongate members being shaped so as to provide the means for retaining the clip in the shoulder.

Another example of securing clip comprises a cylindrical bar of material which is substantially U-shaped in form.

Reference will now be made, by way of example, to the accompanying drawings, in which.

Figure 1:
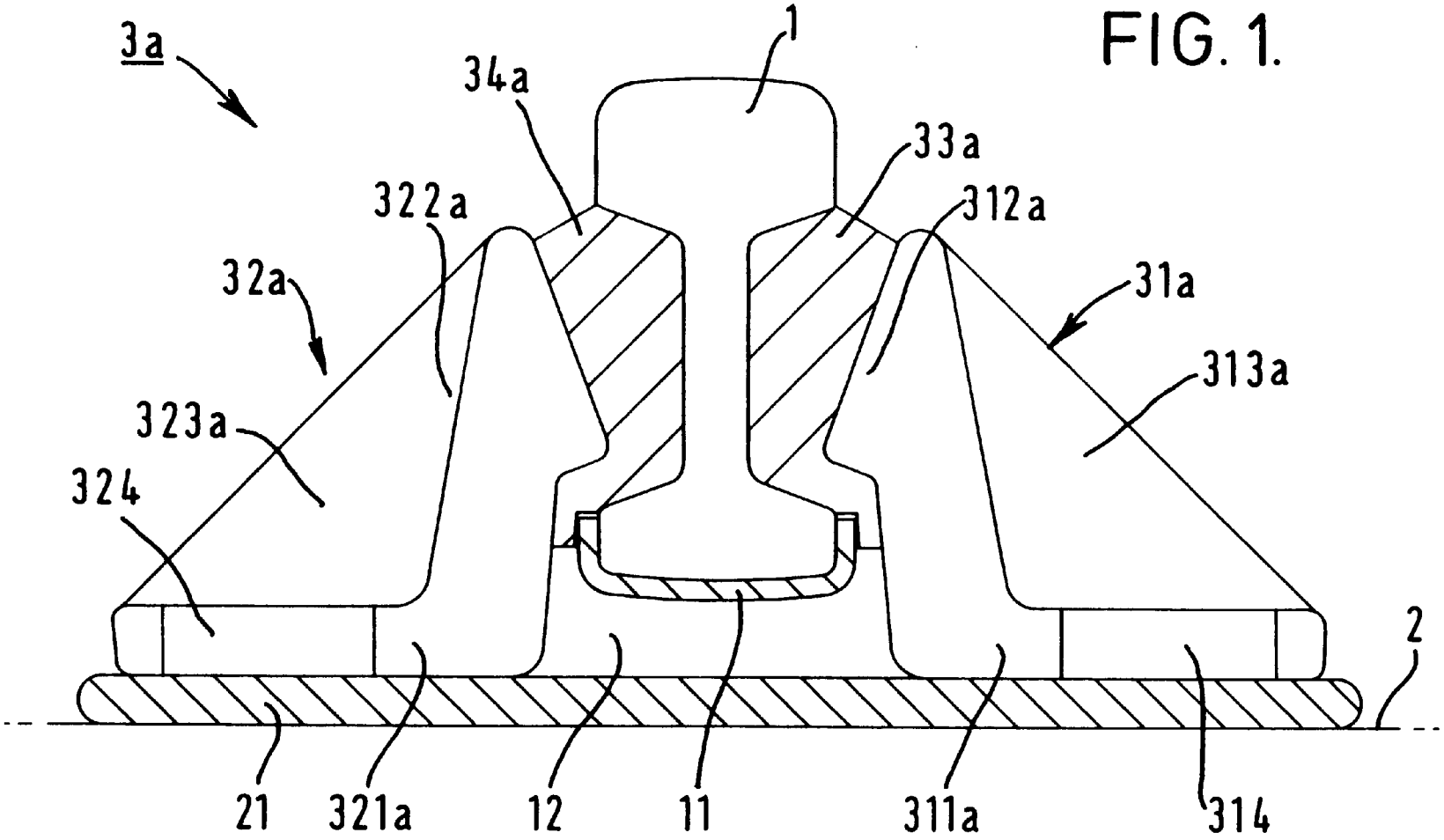
FIG. 1 shows a cross-sectional end view of a first embodiment of the present invention.

FIG. 1 shows an end view of a first assembly 3*a* embodying the present invention, which assembly 3*a* supports a bull-headed rail 1 in place on a track foundation 2.

The embodiment shown in FIG. 1 shows a simplified assembly embodying the present invention and is shown for ease of description.

The assembly 3*a* comprises a first bracket 31*a*, a second bracket 32*a*, a first elastomeric member 33*a* and a second elastomeric member 34*a*. The brackets 31*a* and 32*a* are substantially triangular when viewed from one end, as in FIG. 1, and each has a lower part 311*a* or 321*a* parallel to the track foundation 2, a substantially upright part 312*a* or 322*a* adjacent to the rail 1 and an angled supporting part 313*a* or 323*a*. The substantially upright parts 312*a* and 322*a* are shaped so as to oppose displacement of the elastomeric members 33*a* and 34*a* respectively. These substantially upright parts are shaped so that their load bearing surfaces and the corresponding surfaces of the elastomeric members are inclined to the vertical.

The elastomeric members 33*a* and 34*a* are shaped so as to engage with the rail 1 and the respective brackets 31*a* or 32*a*. In this embodiment, the elastomeric members 33*a* and 34*a* are identical in cross-section, and are used either side of the rail 1.

The first bracket 31*a* is attached to the track foundation 2 by locating means (not shown) projecting through slots 314 and the first elastomeric member 33*a* is located between the first bracket 31*a* and the rail 1. The second bracket 32*a* is also attached to the track foundation 2 by locating means (not shown) projecting through slots 324 and the second elastomeric member 34*a* is located between the rail 1 and the second bracket 32*a*.

The locating means used to attach the brackets 31*a* and 32*a* to the track foundation 2 may be bolts, or rail shoulders, or any suitable fixing device. Several different preferred methods of fixing the brackets will be described later with reference to other embodiments. As can be seen from FIG. 1, the assembly is mounted on a track foundation having a flat top surface, thereby allowing relatively straightforward installation and maintenance of the system. More importantly, however, the assembly allows use to be made of a simple reinforced or pre-stressed concrete slab or sleeper for the track foundation. Such a slab or sleeper is commonly used as a railway track foundation in non-suspended railway systems and can be stronger, and cheaper to produce and install, than a channelled slab or sleeper used in previously-considered suspended rail systems. The extra strength is achieved because there are no shoulder areas, which are difficult to adequately prestress, on such a flat sleeper. In addition, embodiments of the present invention are suitable for use on existing track installations in which no channel currently exists and in which the addition of a channel would be very difficult or disruptive, or prohibitively expensive.

In use, the first and second brackets are adjusted, using the slots 314 and 324, so that the rail 1 is correctly aligned, and so that the first and second elastomeric members 33*a*, 34*a* are held against the rail 1.

In order that the assembly exhibits a desired resistance to longitudinal creep of the rail 1 in response to forces exerted on the rail by a passing train, it is necessary to provide a compressive clamping load to the elastomeric members 33*a* and 34*a*. For example, a compressive clamping load of 15 kN or more would be required for a longitudinal creep resistance of 7 kN. The use of such significant clamping loads allows the rail to be suspended at discrete positions along its length, in contrast with previously-considered systems in which no substantial clamping load was applied, and where resistance to longitudinal rail movement was provided only by the large contact area with the rail in continuous support systems, or by some additional rail fastening provided for this purpose. Resistance to longitudinal rail movement is provided through the characteristics of the system, without the need for additional and separate rail anchors or fasteners.

For example, in this first embodiment, the clamping load is provided by the geometrical arrangement of the assembly. In order to achieve this clamping loading the brackets 31*a* and 32*a* should be held rigidly in place on the track foundation 2.

To install the first embodiment, the brackets 31*a* and 32*a* and the elastomeric members 33*a* and 34*a* should be compressed against the rail 1 using a tool (not shown). This compression clamping loads the elastomeric members to the required level. The assembly is then lowered into place on the track foundation, so that locating means as mentioned above can be used to secure the assembly. The tool is then removed and then installation of the assembly is complete. Since the brackets are rigidly held in place, the clamping load is maintained on the elastomeric members 33*a* and 34*a*.

When the assembly is fitted to a slab track foundation, or to existing track, a suitable grout layer 21 is used, between the brackets 31*a* and 32*a* and the track foundation 2, in order to level the assembly and to adjust the height thereof.

The rail 1 is provided, on a lower foot region thereof, with an insulating layer 11 which serves to ensure that the rail 1 and the brackets 31*a* and 32*a* are electrically insulated, in the event that the rail 1, or the first bracket 31*a*, or the second bracket 32*a*, is significantly displaced beyond its normal working range. The insulating layer 11 also electrically insulates the rail 1 from the brackets 31*a* and 32*a* in the event that a region 12 below the rail 1 and between the brackets 31*a* and 32*a* fills with debris.

Figure 2:
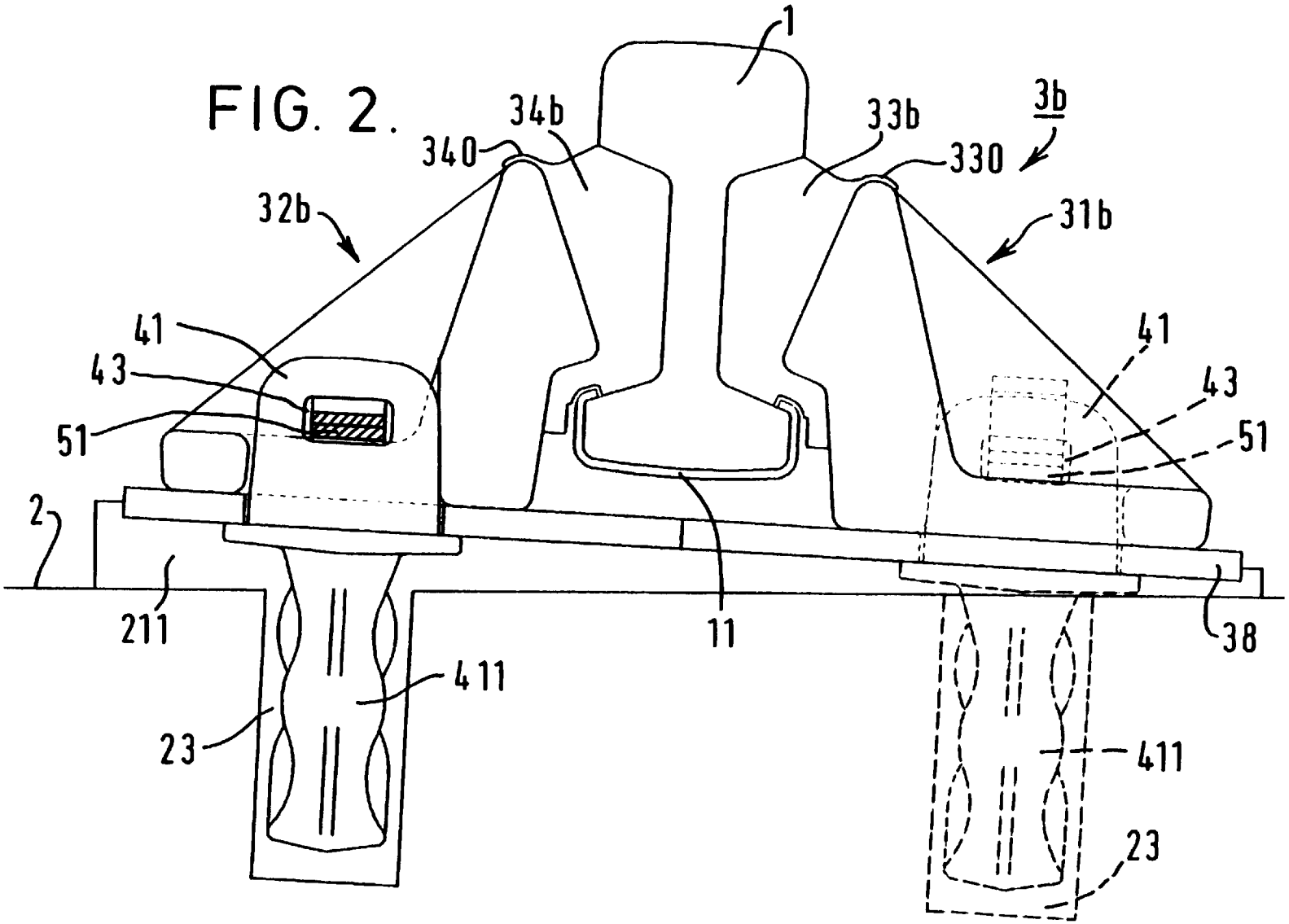
FIG. 2 shows a cross-sectional end view of a second embodiment of the present invention.

FIG. 2 shows a second embodiment of the present invention. Most of the components of the FIG. 2 embodiment are identical to those described with reference to FIG. 1 and so a detailed description will be omitted. The second embodiment provides an assembly 3*b* which supports a rail 1 above a track foundation 2. As in FIG. 1 the rail is supported by brackets 31*b* and 32*b* and elastomeric members 33*b* and 34*b*. These elastomeric members are identical to those in FIG. 1 except for the addition of supporting portions 330 and 340. These portions serve to locate the members on the brackets.

The assembly 3*b* also additionally includes a flat baseplate 38 on which the brackets 31*b* and 32*b* are mounted. Such a baseplate can provide a solid base on which the assembly is mounted. A baseplate is particularly useful if a grout layer is used, as shown in FIGS. 1 and 2.

In FIG. 2, the grout layer 21 shown in FIG. 1 has been replaced by a grout layer 211 which is used to provide the required inclination for the rail 1.

The locating means for holding the brackets 31*b* and 32*b* are constituted by shoulders 41 which project through the slots in the brackets. Clips 51 are inserted, through holes 43 in the shoulders 41, to hold the brackets in position. As in the FIG. 1 embodiment, the clamping load that is required to be applied to the elastomeric members 33*b* and 34*b* is provided by the fit of the assembly.

The shoulders 41 can be glued into recess 23 in the track foundation 2 (as shown in FIG. 2), or can be cast into the track foundation 2, by means of projecting portions 411.

Figure 3:
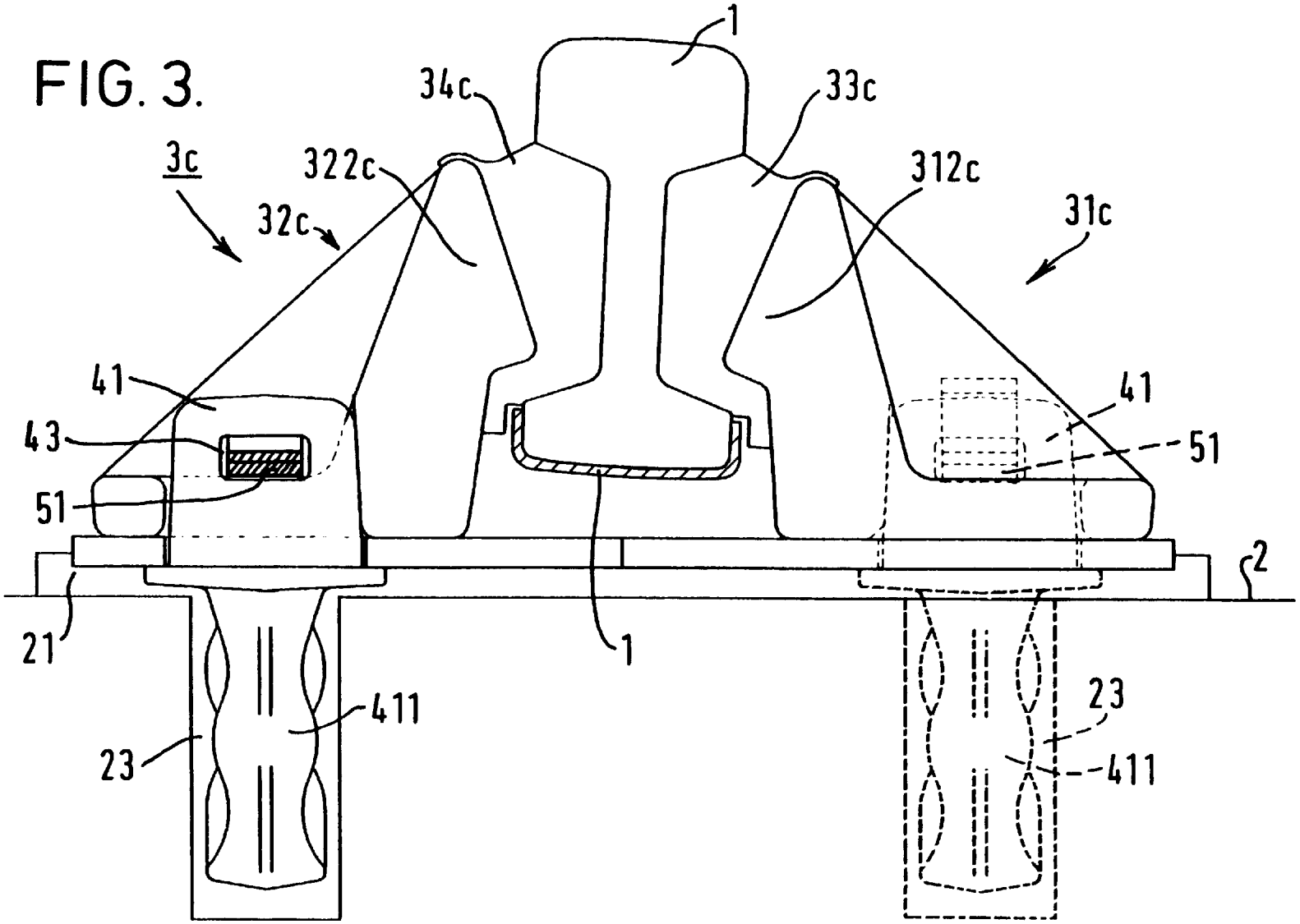
FIG. 3 shows a cross-sectional end view of a third embodiment of the present invention.

A third embodiment is shown in FIG. 3. This embodiment is very similar to that shown in FIG. 2, except that the rail 1 is inclined by means of brackets 31*a* and 32*c* having differing respective upright portions 312*c* and 322*c*. Such differently-shaped brackets are used with elastomeric members 33*c* and 34*c* which are identical in cross-section. The FIG. 3 embodiment is shown in use with a bull-headed rail 1, although, as with all embodiments of the present invention, this embodiment could be used with a flange-footed rail. As in FIG. 2, the FIG. 3 embodiment uses glued-in or cast-in shoulders 41 with clips 51 being used to hold the assembly in place. The required clamping load is once again provided by the fit of the assembly.

Figure 4:
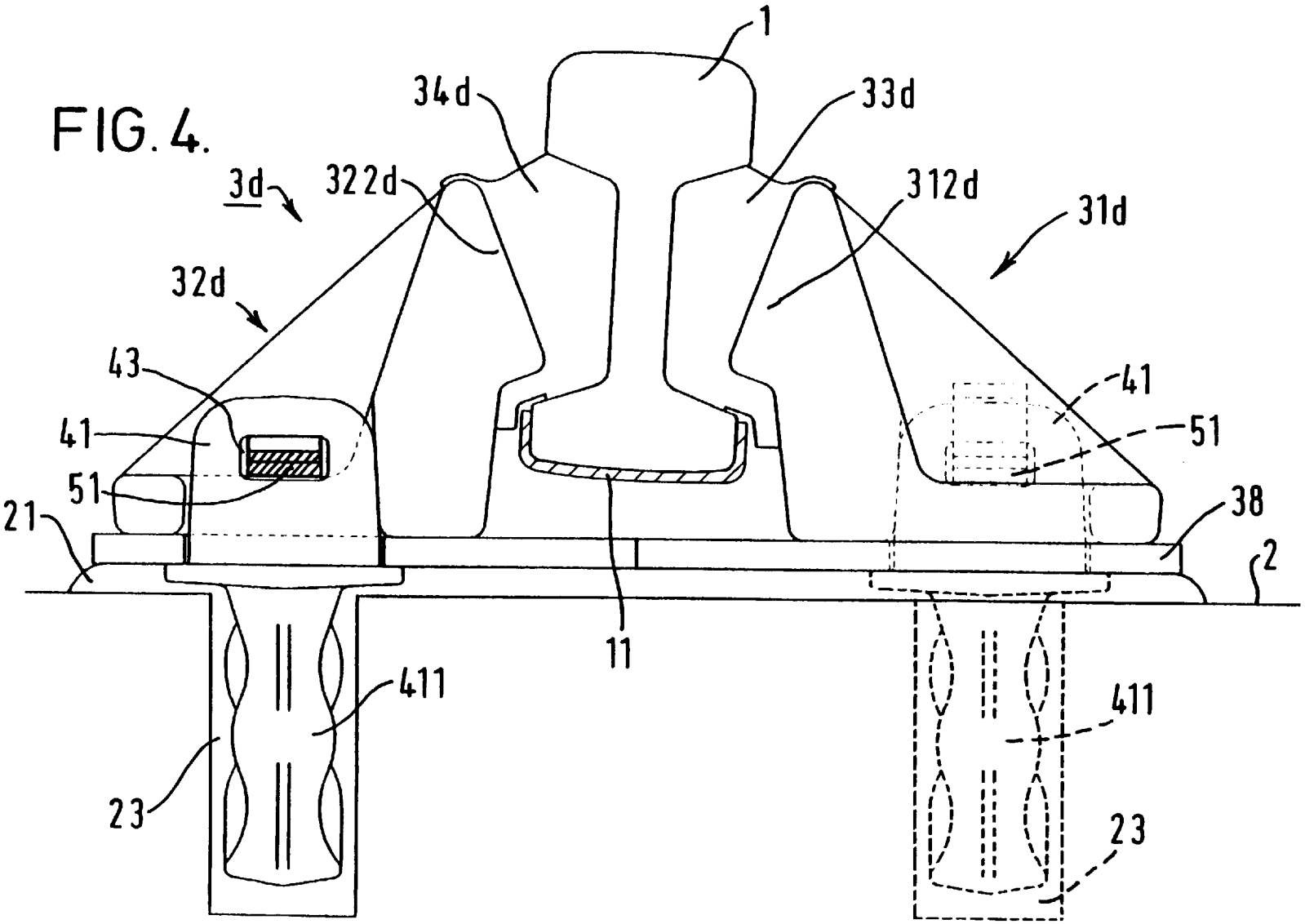
FIG. 4 shows a cross-sectional end view of a fourth embodiment of the present invention.

A fourth embodiment of the present invention is shown in FIG. 4. This fourth embodiment is very similar to the second and third embodiments, but in the fourth embodiment inclination of the rail is provided by the use of non-identical elastomeric parts 33*d* and 34*d* in combination with brackets 31*d* and 32*d* having identical cross-sections. The assembly is again held down in position by means of clips 51 inserted through shoulders 41 which are glued-in, cast-in or grouted-in to the track foundation 2.

Figure 5:
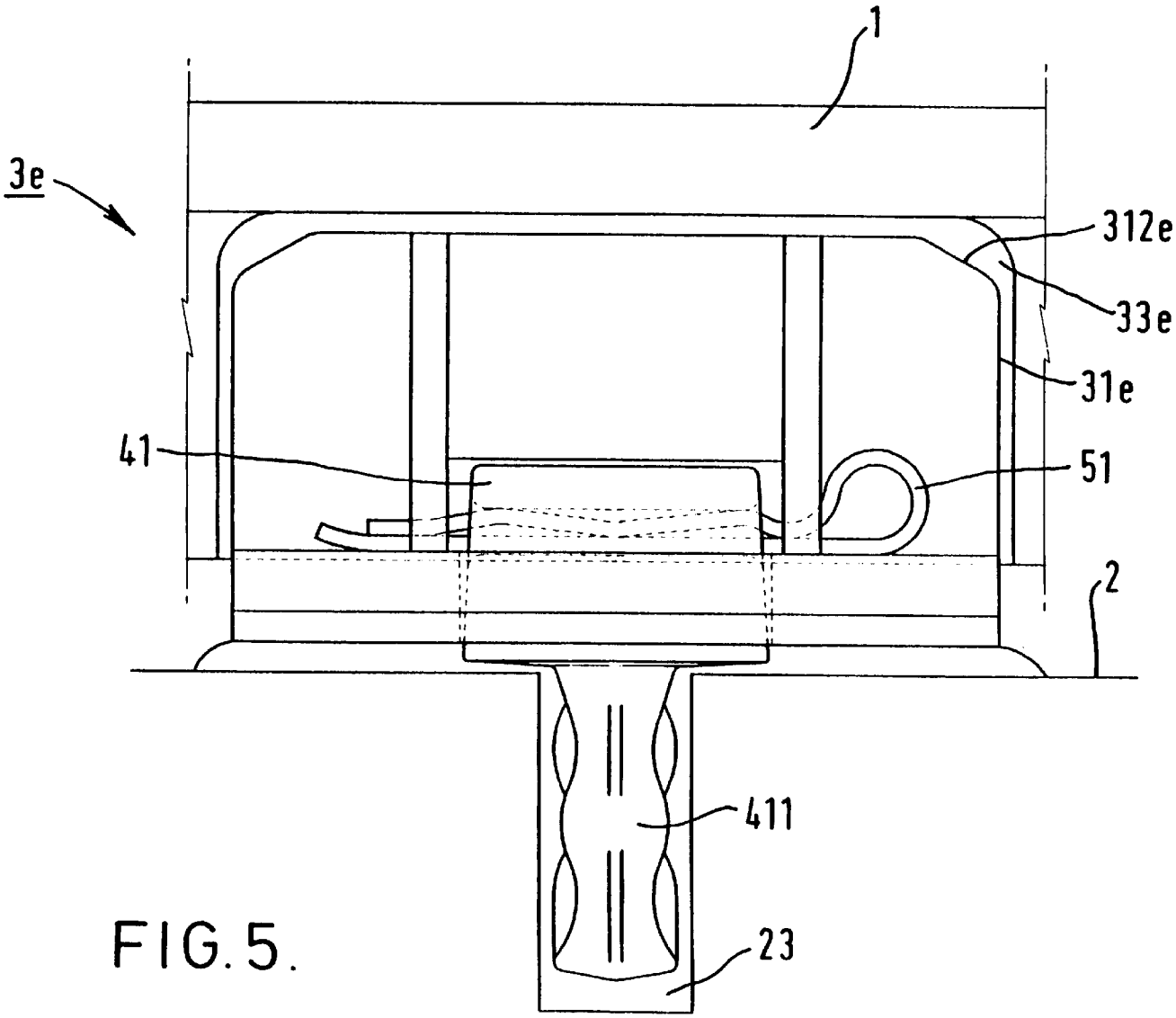
FIGS. 5 and 6 show side and plan views respectively of a fifth embodiment of the present invention.
Figure 6:
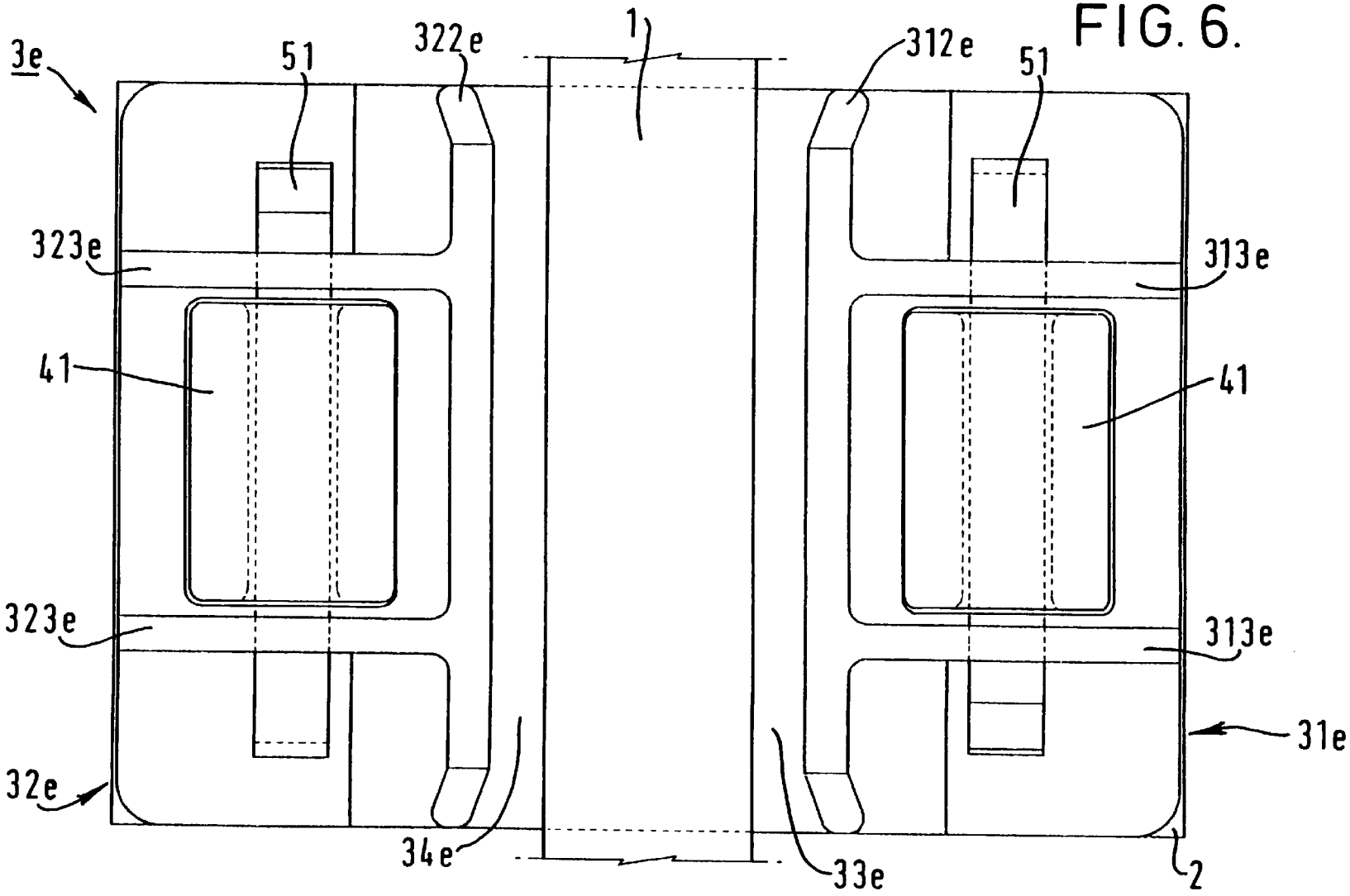

FIGS. 5 and 6 show side and plan views respectively of a fifth embodiment of the present invention, which is similar to the second, third and fourth embodiments described above. In FIGS. 5 and 6 a rail 1 is held in place on a track foundation 2 by means of a rail support assembly 3*e*.

The assembly 3*e* comprises first and second brackets 31*e* and 32*e*, and first and second elastomeric members 33*e* and 34*e*. The elastomeric members 33*e* and 34*e* are similar to those used in previous embodiments.

However, in order to ensure that the change of rail support stiffness along the rail is not an abrupt one, as discussed above, the brackets 31*e* and 32*e* are specially shaped. Upright portions 312*e* and 322*e* are sloped outwardly, away from the rail, in the longitudinal direction of the assembly, and downwardly at the longitudinal ends of the assembly, in order to reduce the rate of change in track modulus (track stiffness per metre) as the wheel reaches the assembly.

Although the length of bending waves due to trains travelling on the rail at the levels of support stiffness for which the support system will generally be designed is sufficiently long that the apparent difference of track support stiffness between positions above the assembly and in mid-span between two assemblies is very small, this difference can be further reduced by such shaping of the brackets 31*e* and 32*e*.

Thus, the discrete assembly of this embodiment is designed with the shape of the support brackets, when viewed in a horizontal plane in a direction perpendicular to the axis of the rail, being such as to ensure that there is no abrupt transition between the support stiffness above an assembly and its span. Any harmonic excitation due to variations in support stiffness along the length of the track is therefore inconsequentially small. The good vibration producing properties of a previously-considered continuous system can be retained in a discrete system embodying the present invention.

In addition, because of the small change of support stiffness along the length of the track there is no tendency for there to be increased rail stress at the edge of the assembly.

Figure 7A:
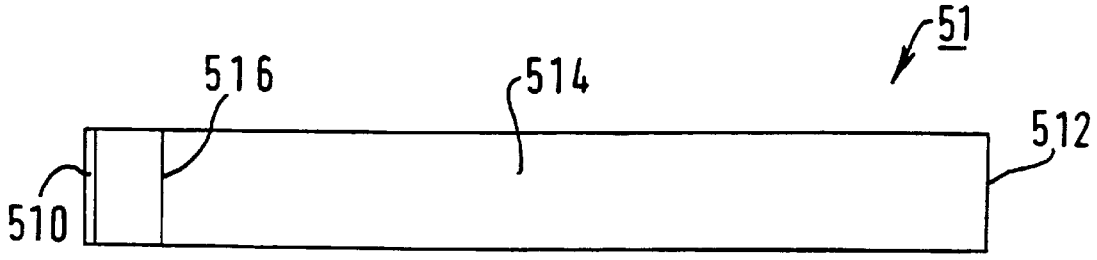
FIGS. 7A and 7B show plan and side views respectively of a clip for use in the embodiments of FIGS. 2 to 6.
Figure 7B:
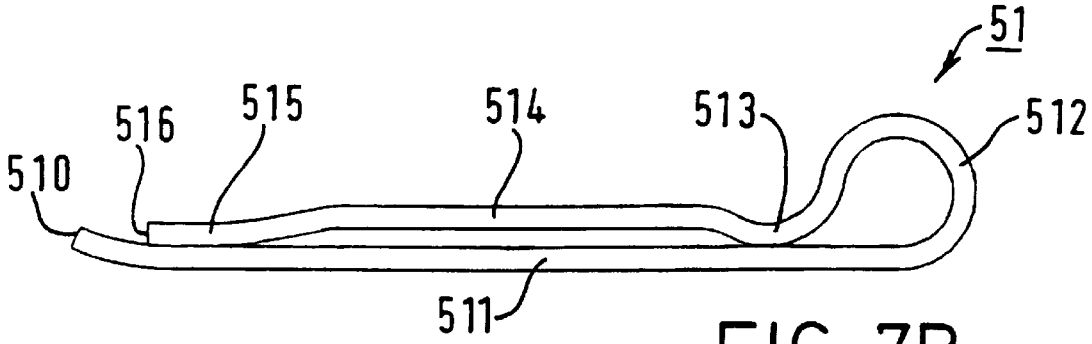

FIGS. 7A and 7B show in more detail the undeflected shape of the clip 51 shown in use with the second to fifth embodiments. The clip 51 is formed from a flat bar of resilient material, for example steel. The clip has a curved front portion 510, a flat portion 511, a curved rear portion 512, a curved portion 513, a flat portion 514, a curved portion 515, and a flat front portion 516.

When in use, the clip 51 is inserted into a shoulder 41 and is held in place by its own resilience as shown in FIG. 5. The shape of the rear portion 512 of the clip aids insertion of the clip into the shoulder 41. The clip is designed to be substantially rigid in the vertical direction once installed, so that any deflection of the assembly due to loading is made up by the elastomeric members, and not the clip.

This design of clip is relatively easy to insert into the shoulder 41, and provides a substantially or near rigid fixing for the bracket. The resilience of the clip allows vertical tolerances within the assembly to be taken up, thereby maintaining the brackets in position and hence the required clamping load in the assembly, since this clamping load is fundamentally determined by the geometry of the assembly.

In addition to the clip described above, a layer of elastic material may be located between the substantially parallel parts 511 and 514, in order to increase the stiffness of the clip 51.

Figure 8B:
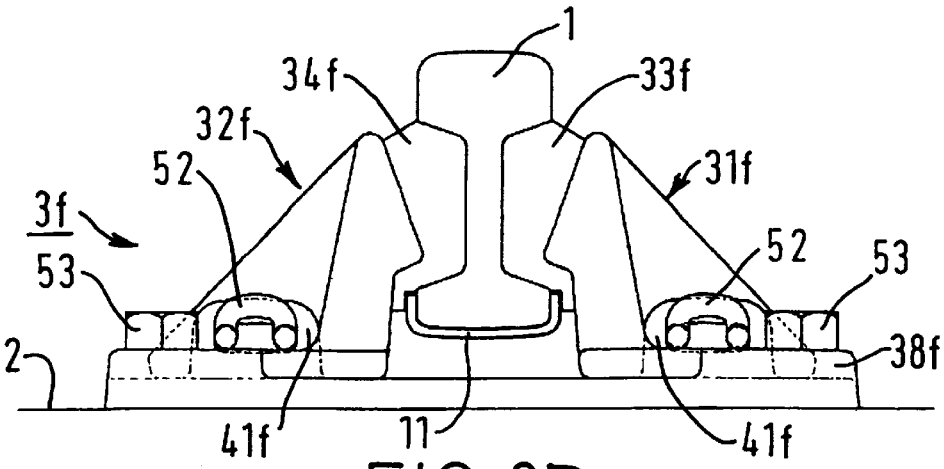
FIG. 8B shows an end view of the sixth embodiment of the present invention.
Figure 8A:
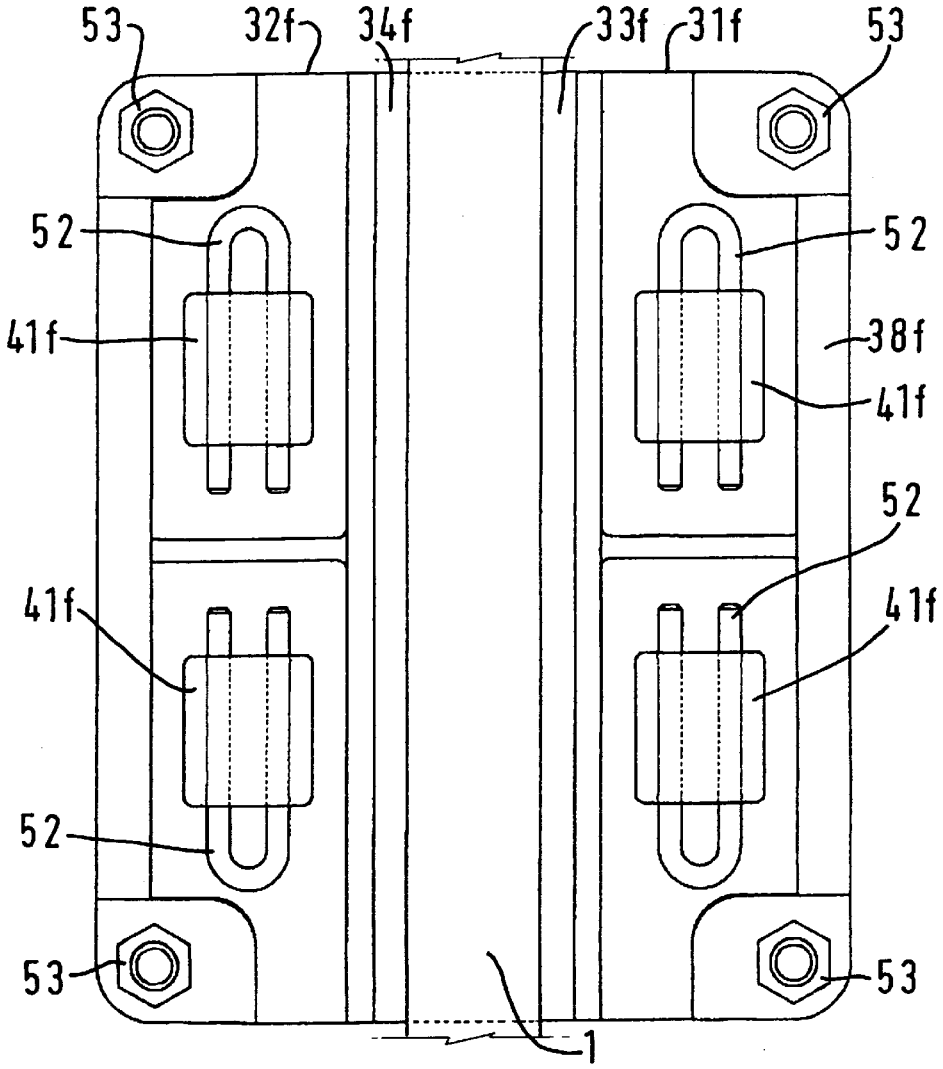
FIG. 8A shows a plan view of a sixth embodiment of the present invention.

FIGS. 8A and 8B show respective end and plan views of a sixth embodiment of the present invention. Once again, a bull-headed rail 1 is held on in place on a track foundation by means of an assembly 3*f*.

In the sixth embodiment, the assembly 3*f* comprises components similar to those used in the previous embodiments, namely first and second brackets 31*f* and 32*f*, and first and second elastomeric members 33*f* and 34*f*. This embodiment also includes a base plate 38*f* on which the assembly is mounted.

The base plate 38*f* is attached to the track foundation 2 by means of bolts 53, and includes upstand portions 41*f*, which pass through slots (not shown) in the brackets 31*f* and 32*f* when the brackets are mounted in place. The first and second brackets 31*f* and 32*f* are similar in shape to those described with reference to FIG. 1, and are held in position on the base plate 38*f* by means of clips 52 which pass through respective holes in the upstanding portions 41*f* of the baseplate 38*f*. The clips 52 have the same function as the clips 51 described with reference to FIG. 7, but differ in shape to those FIG. 7 clips, being substantially U-shaped when viewed in plan, when in use. As in the FIG. 7 assembly, the clip is used to keep the brackets in place, and the necessary clamping load is applied to the elastomeric members 33 and 34 by the fit of the assembly.

As in the other embodiments the rail is flexibly held in place by the brackets 31*f* and 32*f* compressing the elastomeric members 33*f* and 34*f* against the rail 1. The rail 1 is provided with an insulating layer 11, and a suitable grout layer (not shown) may be used to level the assembly as before.

Figure 9:
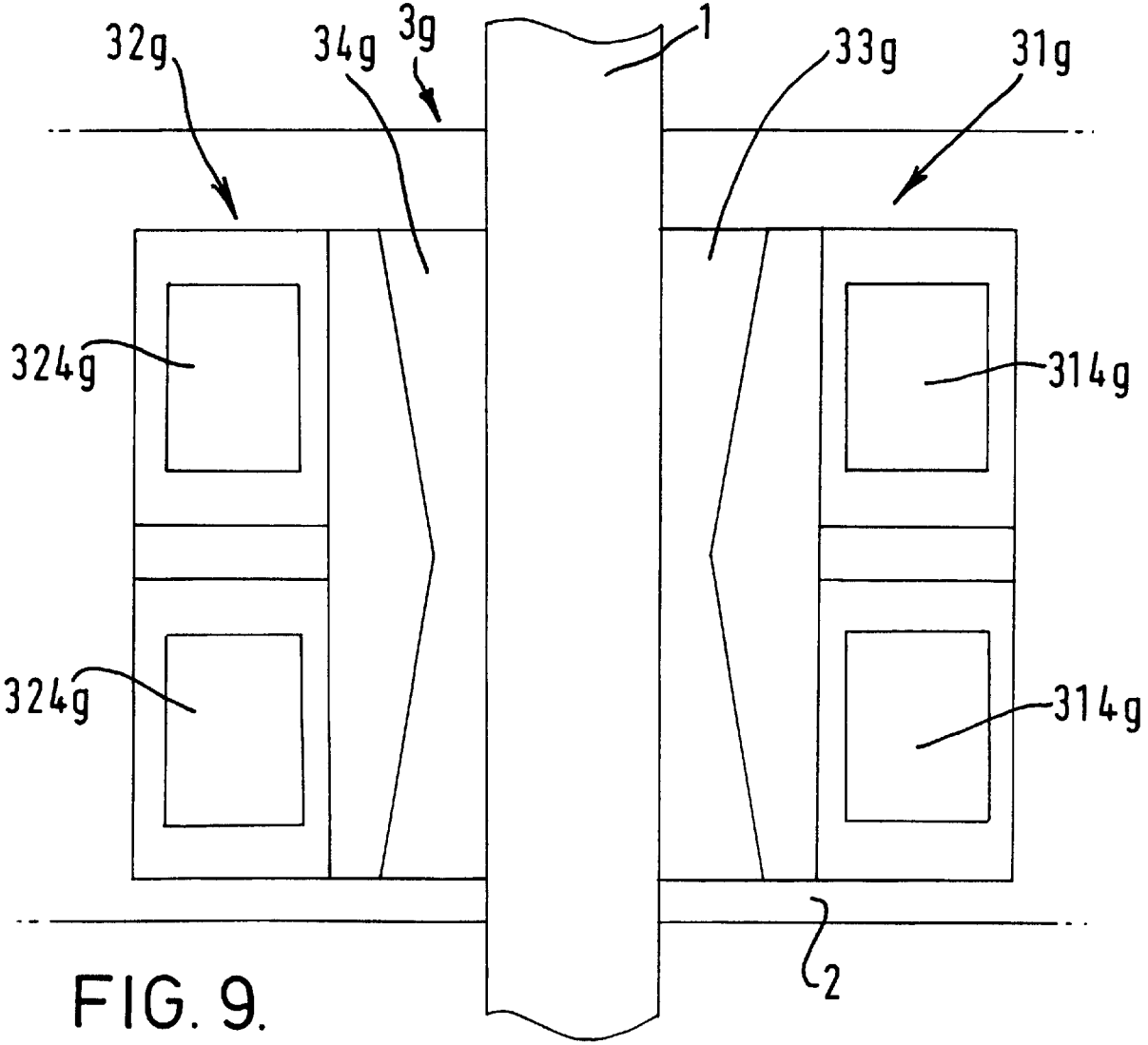
FIG. 9 shows a plan view of a seventh embodiment of the present invention.

FIG. 9 shows a plan view of a seventh embodiment of the present invention. As in previously described embodiments, a rail 1 is held on place on a track foundation 2 by means of an assembly 3*g*. The assembly 3*g* in the seventh embodiment comprises first and second brackets 31*g* and 32*g*, and first and second elastomeric members 33*g* and 34*g* which are held by the brackets against the sides of the rail 1.

As described with reference to FIG. 1, locating means (not shown) project through holes 314*g* and 324*g* in the brackets 31*g* and 32*g* and are used to hold the brackets in place on the track foundation 2. As in the other embodiments, a base plate and/or grout layer may be used between the brackets 31*g* and 32*g* and the track foundation 2.

As can be seen from FIG. 9, the brackets 31*g* and 32*g* are specially shaped, the upright portions being narrow at the longitudinal edges of the assembly and widening to a maximum thickness at the centre of the assembly. The elastomeric members 33*g* and 34*g* are correspondingly shaped so as to have wide portions at the longitudinal edges of the assembly and narrow portions at the centre thereof. The shaping of the brackets and elastomeric portions serves to increase resistance of the assembly to longitudinal creep of the rail 1 through the assembly. This increase is achieved because the angled shape of the elastomeric portions serves to increase the clamping load, and hence the resistance to creep, as the rail 1 creeps in a longitudinal direction.

As an alternative (not shown), the brackets may be shaped so as to have wide portions at the longitudinal edges of the assembly and a narrow portion at the centre of the assembly. Correspondingly, the elastomeric members would be shaped so as to have narrow portions at the longitudinal edges of the assembly, and a wide portion at the centre of the assembly. Cooperating shaping of the elastic members and side brackets could also serve to locate and fix them together, and to limit the distortion of the elastic elements under load. For example, a protrusion on the face of the elastic member could engage with a recess in the corresponding face of the side bracket, allowing the two to be fixed together and preventing any tendency for the elastic element to be forced upwards when the clamping load is applied (not shown).

The clamping load application method discussed above has some drawbacks. One of these is that it may be necessary to clamp and locate a number of consecutive assemblies before they can be dropped into place. This can make assembly and maintenance somewhat more difficult.

Figure 10:
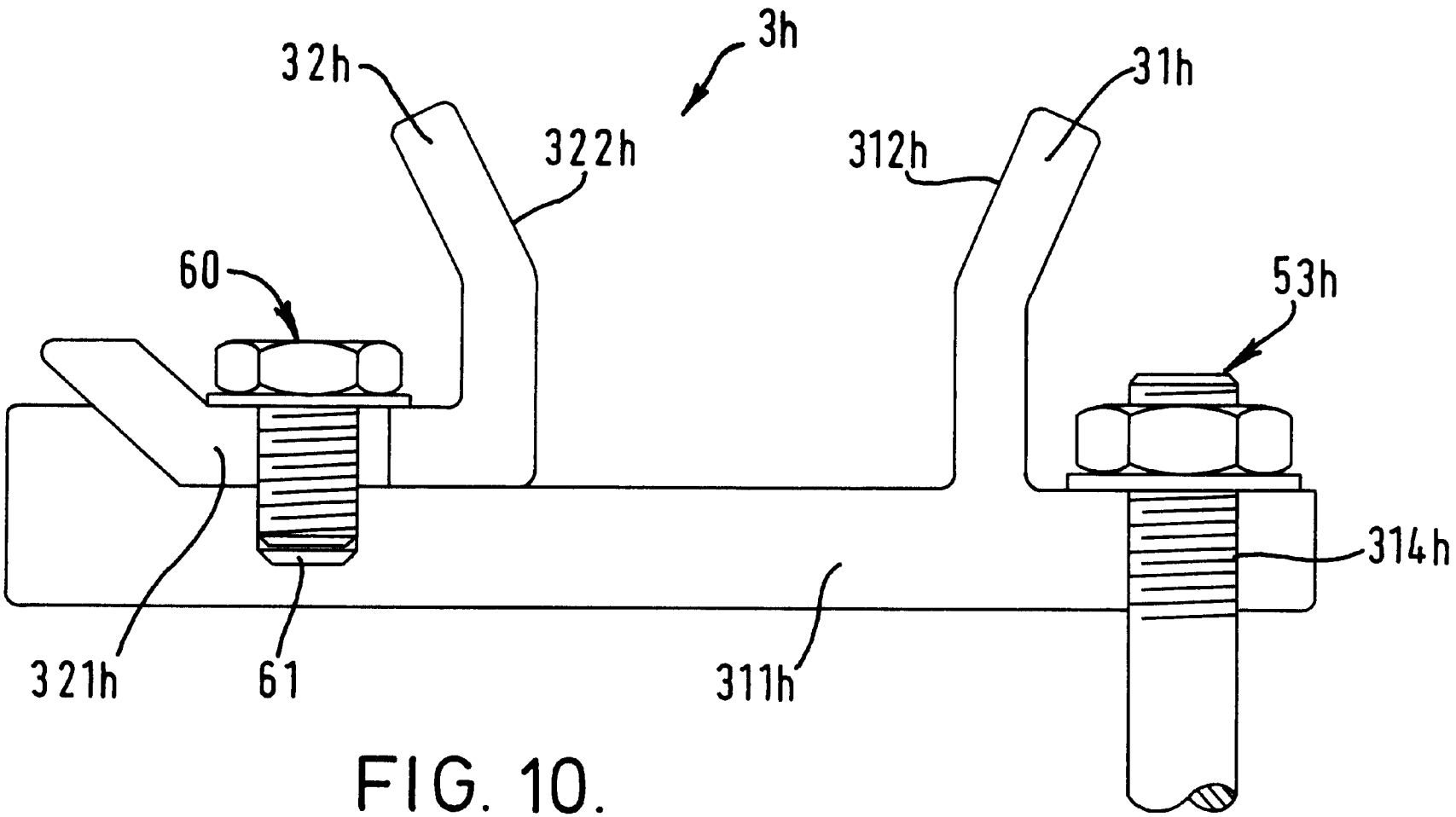
FIG. 10 shows a part cross-sectional end view of part of an eighth embodiment of the present invention.

FIG. 10 shows a cross-sectional end view of parts of an eighth embodiment of the present invention. Brackets 31*h* and 32*h* shown in FIG. 10 are used in place of the first and second brackets 31 and 32 of the previously-described embodiments.

As will be seen from FIG. 10, the bracket 31*h* has a lower part 311*h* which extends, when the assembly is in use, from the first bracket side to the second bracket side of the assembly. The first bracket 31*h* also has an upright portion 312*h* which is adjacent to a rail (not shown) when the assembly is in use, and which supports an elastomeric member (not shown) against the rail in a similar manner to the previously-described embodiments.

The second bracket 32*h* is located on an upper face of the extended lower part 311*h* of the first bracket 31*h*. As in previous embodiments, the second bracket 32*h* is located on the opposite side of the rail to the first bracket 31*h* when the assembly is in use, and supports a second elastomeric member (not shown) against the rail, on the opposite side of the rail to the first bracket 31*h*.

The first bracket 31*h* is held onto the track foundation (not shown) by means of bolts 53*h* located through slots 314*h* (only one bolt and one slot being shown in FIG. 10). The second bracket 32*h* is secured to the extended lower part 311*h* of the first bracket 31*h* by means of a bolt 60 located through a hole in the lower part 32*h* of the said second bracket 32*h*, which bolt extends into a threaded hole 61 in the extended lower part 311*h* of the first bracket 31*h*.

The eighth embodiment of the present invention allows the first bracket 31*h*, including its lower part 311*h*, to be bolted to the track foundation 2 before installation of the complete rail assembly. The rail, the elastomeric members, and the second bracket 32*h* are then lowered onto the track foundation so that the rail is held between the first and second elastomeric members as in the previous embodiments. The necessary clamping load may then be applied to the elastomeric members by compressing the second bracket 32*h* towards the first bracket 31*h* by the use of a tool (not shown). The bracket 32*h* is then bolted to the lower part 311*h* of the bracket 31*h* using the bolt 60. Thus, the second bracket is fixed in position relative to the first bracket 31*h* and the rail, and so the applied clamping load remains after the tool is removed. Such an embodiment of the present invention allows for easier installation of the assembly.

Figure 11:
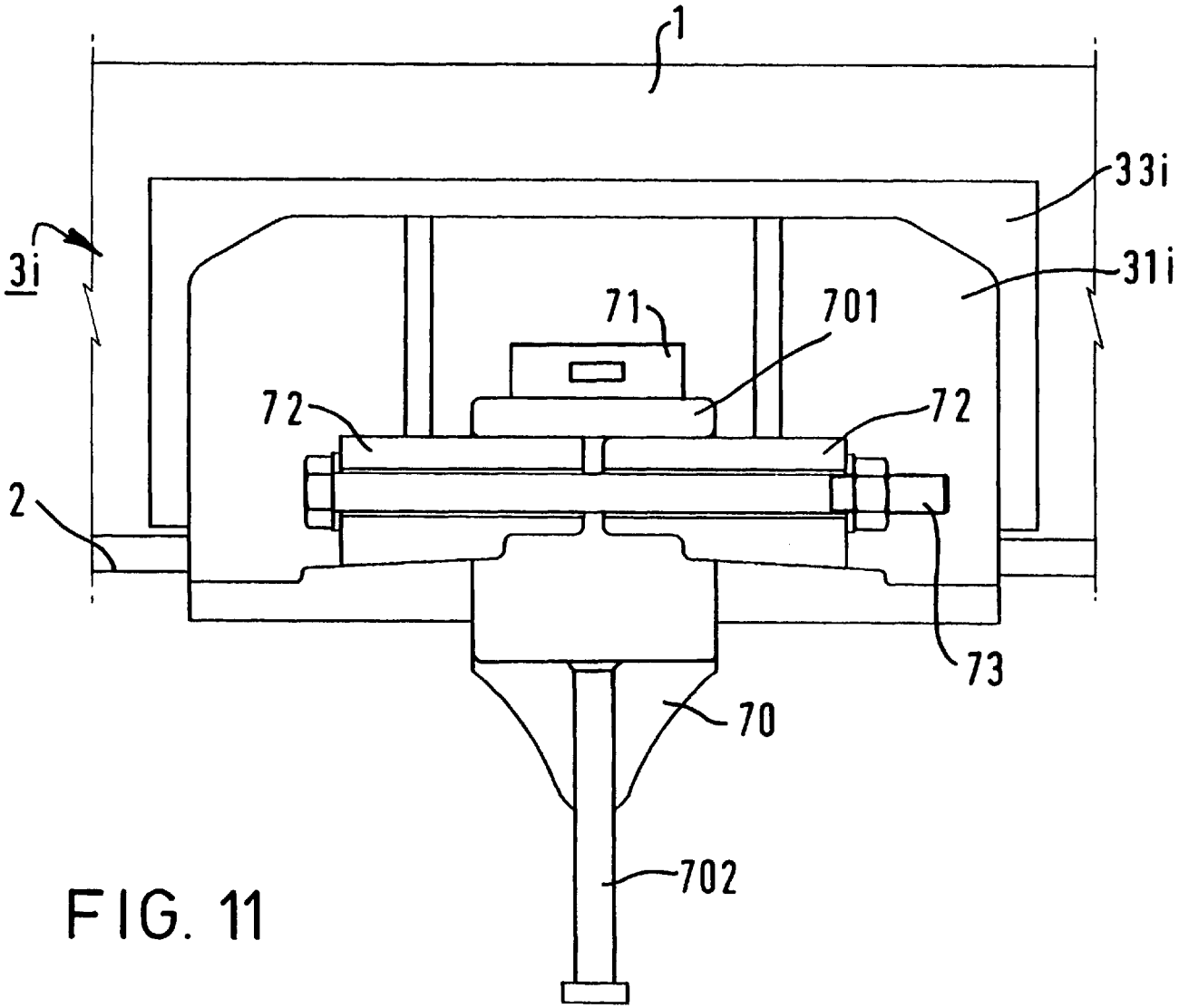
FIGS. 11 and 12 show part cross-sectional side and end views respectively of a ninth embodiment of the present invention.
Figure 12:
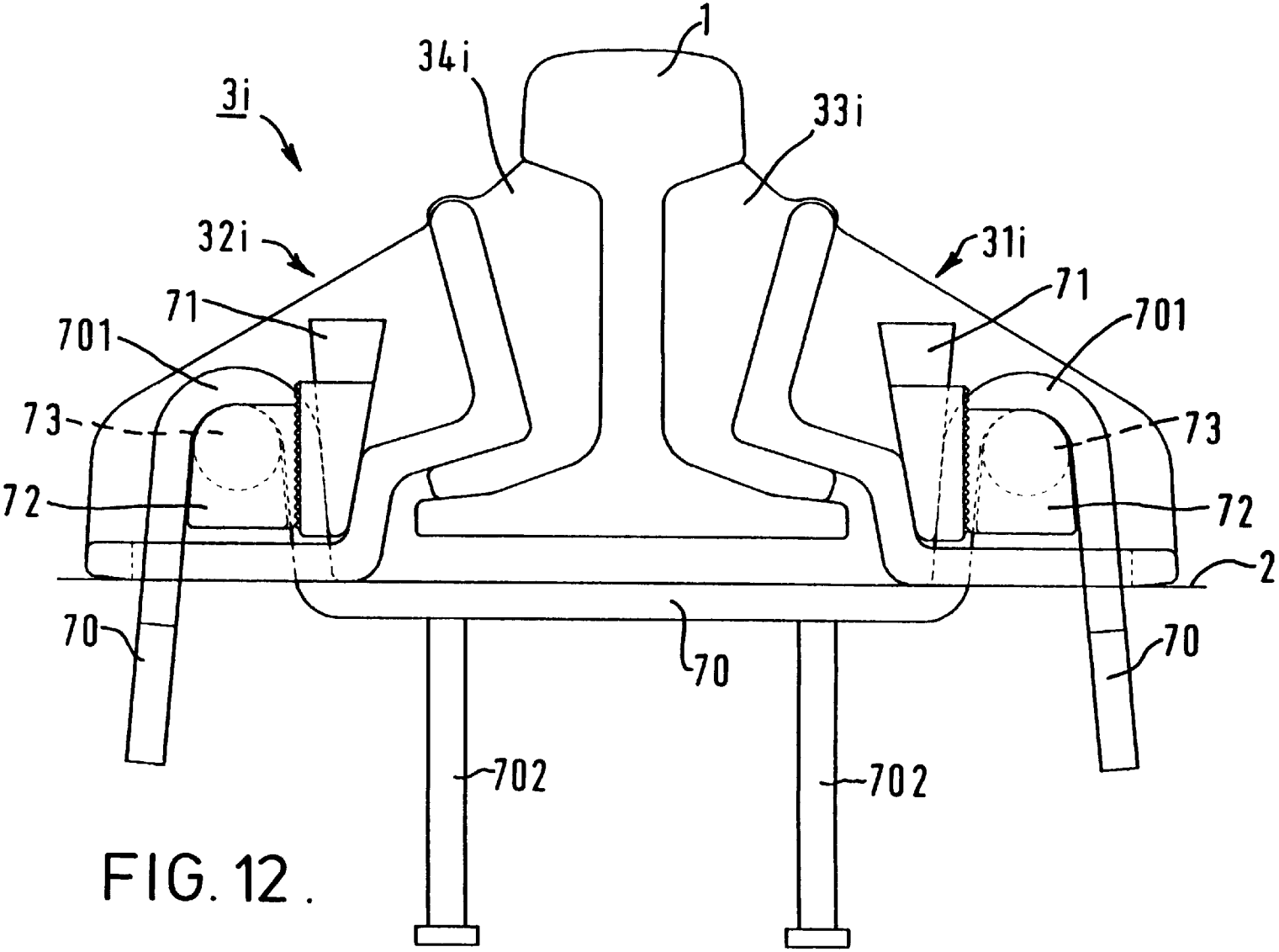

FIGS. 11 and 12 show side and end views respectively of a ninth embodiment of the present invention. This ninth embodiment uses brackets 31*i* and 32*i* and elastomeric members 33*i* and 34*i* which are similar to the brackets and elastomeric members used by other embodiments described with reference to the previous figures.

The ninth embodiment is concerned with the way in which the required clamping load is applied to the elastomeric members 33*i* and 34*i*, and with the way in which tolerances within the assembly can be taken up. In other aspects the similarities between the ninth embodiment and the previous embodiments will be apparent from the drawings, and so a detailed explanation will be omitted.

In order to apply the required clamping load, the assembly 3*i*, consisting of the rail 1, the first and second brackets 31*i* and 32*i* and the elastomeric members 33*i* and 34*i*, is placed, in an uncompressed state, onto the track foundation 2 so that respective slots in the brackets 31*i* and 32*i* pass over portions 701 of a pressed clamping base plate 70. This clamping base plate 70 is set into the track foundation 2 at end regions thereof contiguous with the portions 701 and at a central region 702 thereof. The portions 701 project upwardly from the track foundation 2 so as to define respective apertures between the brackets and the portions 701.

Figure 13:
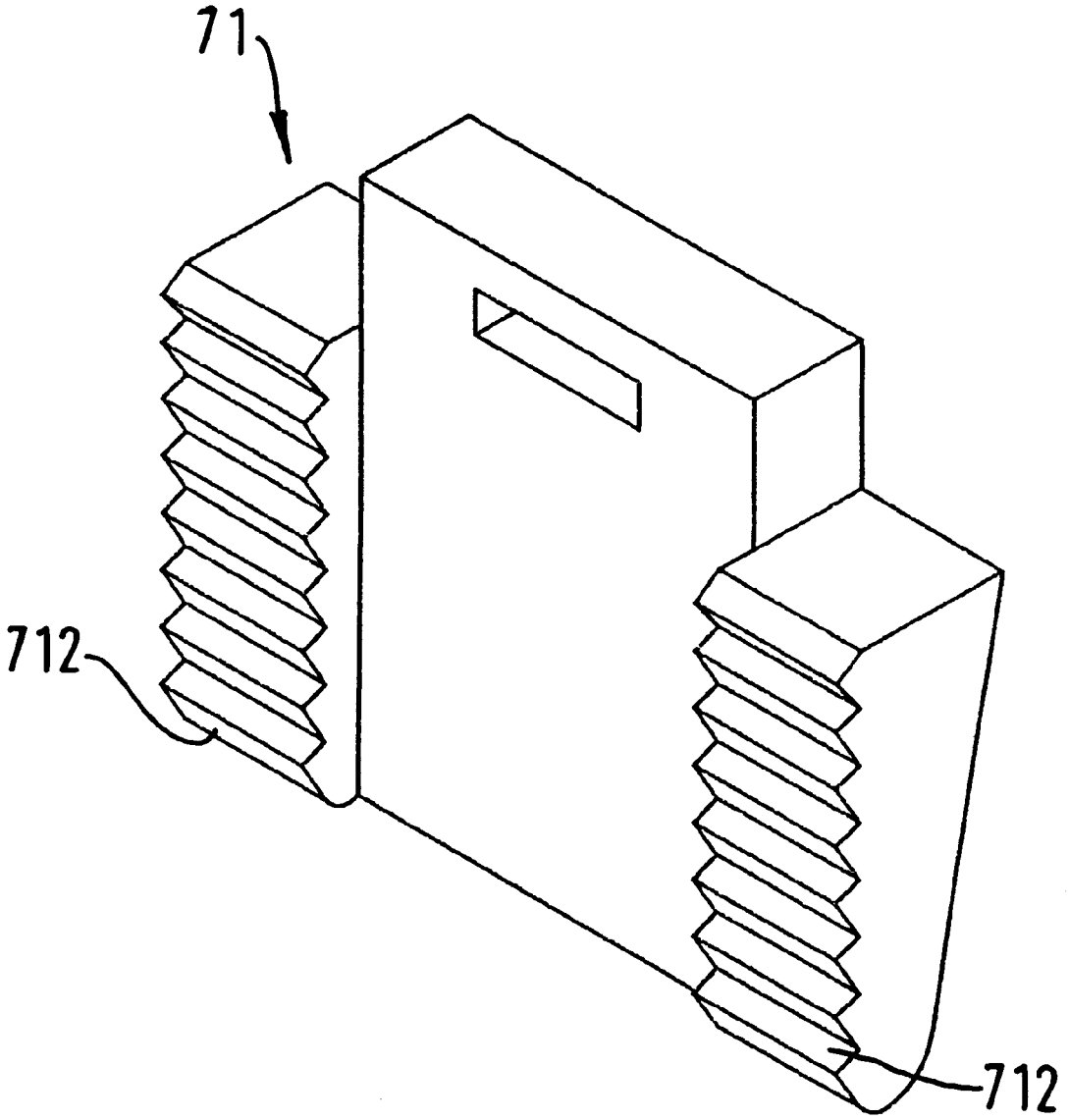
FIGS. 13 and 14 show respective perspective views of parts which may be used in the embodiment of FIGS. 11 and 12.

The assembly is then compressed using a clamping tool (not shown). A first wedge part 71 is then inserted in a downward vertical direction between the projecting portions 701 and the brackets 31*i* and 32*i*. One such first wedge part is used for each side of the rail assembly. A first wedge part 71 which has two laterally spaced sets of serrated edges 712 is shown to an enlarged scale in FIG. 13.

Figure 14:
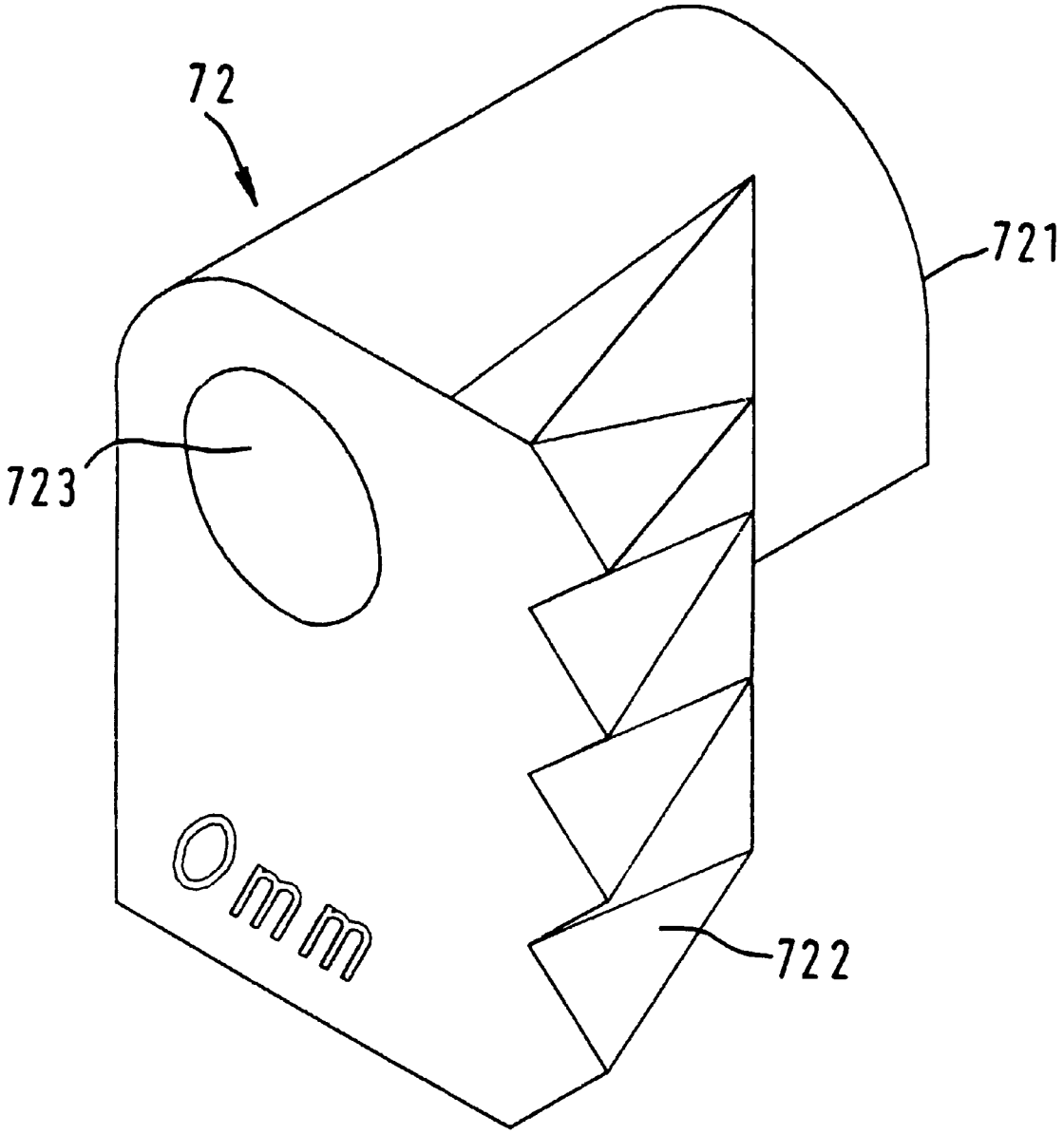

Next, a second wedge part 72 which has a single set of serrated edges 722 is inserted into each end of the assembly. A pair of second wedge parts 72 is used for each side of the assembly, as will be apparent from FIG. 11. A second wedge part 72 is shown to an enlarged scale in FIG. 14. The two second wedge parts 72 on each side of the assembly thus engage with the respective first wedge part 71 on the same side of the assembly by means of their respective serrated edges 712 and 722. These serrated edges serve to prevent the first wedge part 71 moving out of the assembly when the clamping tool is removed.

A bolt 73 is inserted through an aperture 723 (FIG. 14) in the second wedge parts 72. The bolt 73 passes through one of the second wedge parts 72, through the aperture defined by the portion 701 and then through another of the second wedge parts 72 located at the opposite end of the assembly.

The bolt 73 is tightened so the tolerances in the assembly are taken up, hence rigidly fixing the side brackets in position. Since the brackets are locked rigidly in place, the clamping load can be maintained, even when the clamping tool is removed. The shape of the second wedge part 72 can be made so that as the bolt 73 is tightened the assembly tends to compress the elastomeric members more, thereby increasing the applied clamping load.

The clamping tool is then released and the interlocking serrated edges of the wedge parts 71 and 72 serve to hold the wedge part 71 in place in the assembly, as mentioned above. The use of wedge portions 71 and 72 allows the brackets 31*i* and 32*i* to be rigidly held in position, and the tolerances of the assembly taken up, so that the elastomeric members 33*i* and 34*i* have the appropriate clamping load applied thereto.

In addition to providing a lateral clamping load to the elastomeric members, such an assembly can ensure that the side brackets are rigidly held in place, so the vibration-reducing characteristics of the assembly are not reduced.

Figure 15:
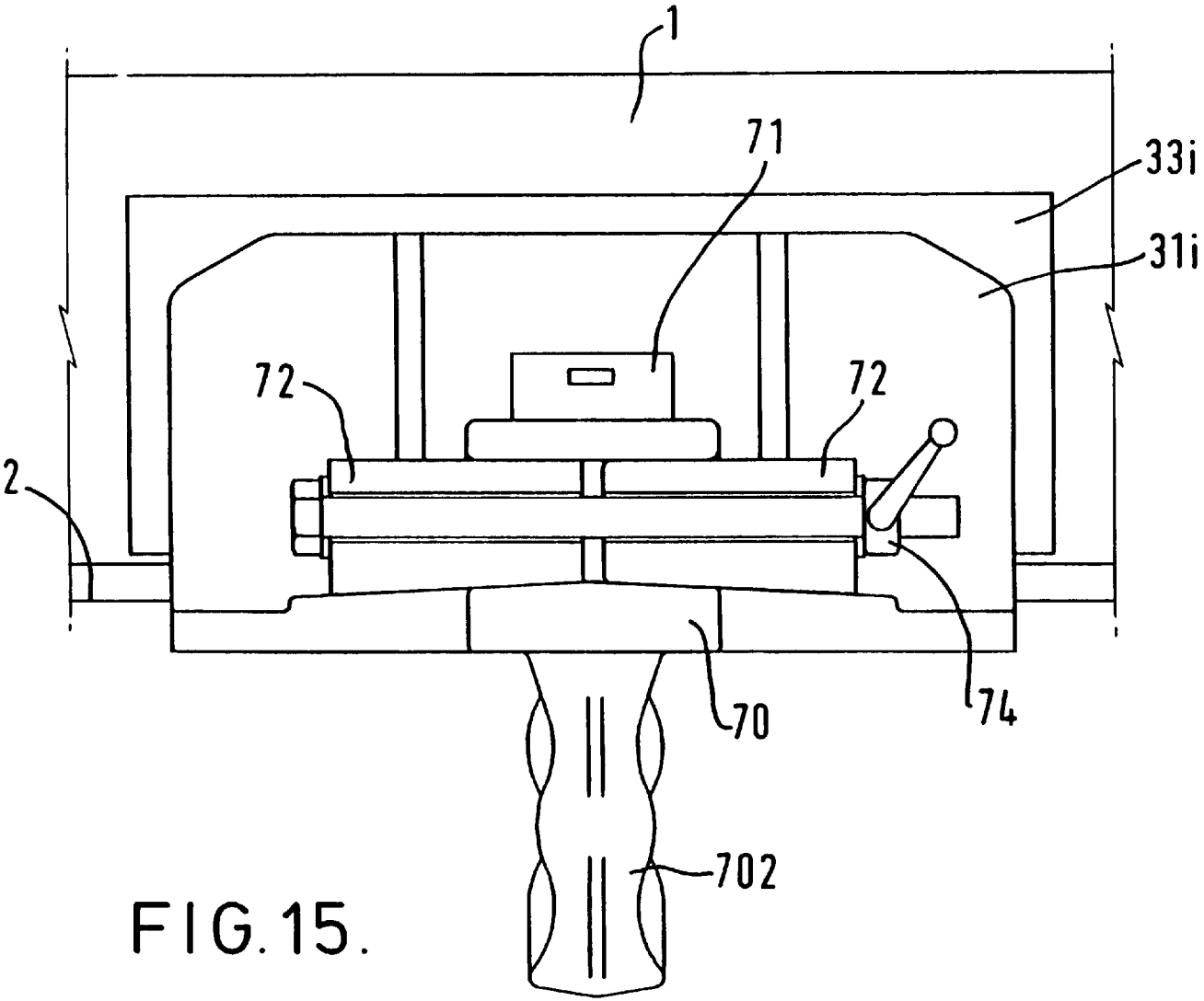
FIG. 15 shows a part cross-sectional side view of a first modification of the ninth embodiment of FIGS. 11 and 12.

FIG. 15 shows an end view of a modification of the ninth embodiment of the present invention. This modification is substantially identical to the ninth embodiment, with the exception that a toggle clamp 74 is used to secure the first and second wedge parts 71 and 72 in place in the assembly, instead of the bolt 73. In addition, the FIG. 15 embodiment uses a cast clamping base plate 70.

Figure 16:
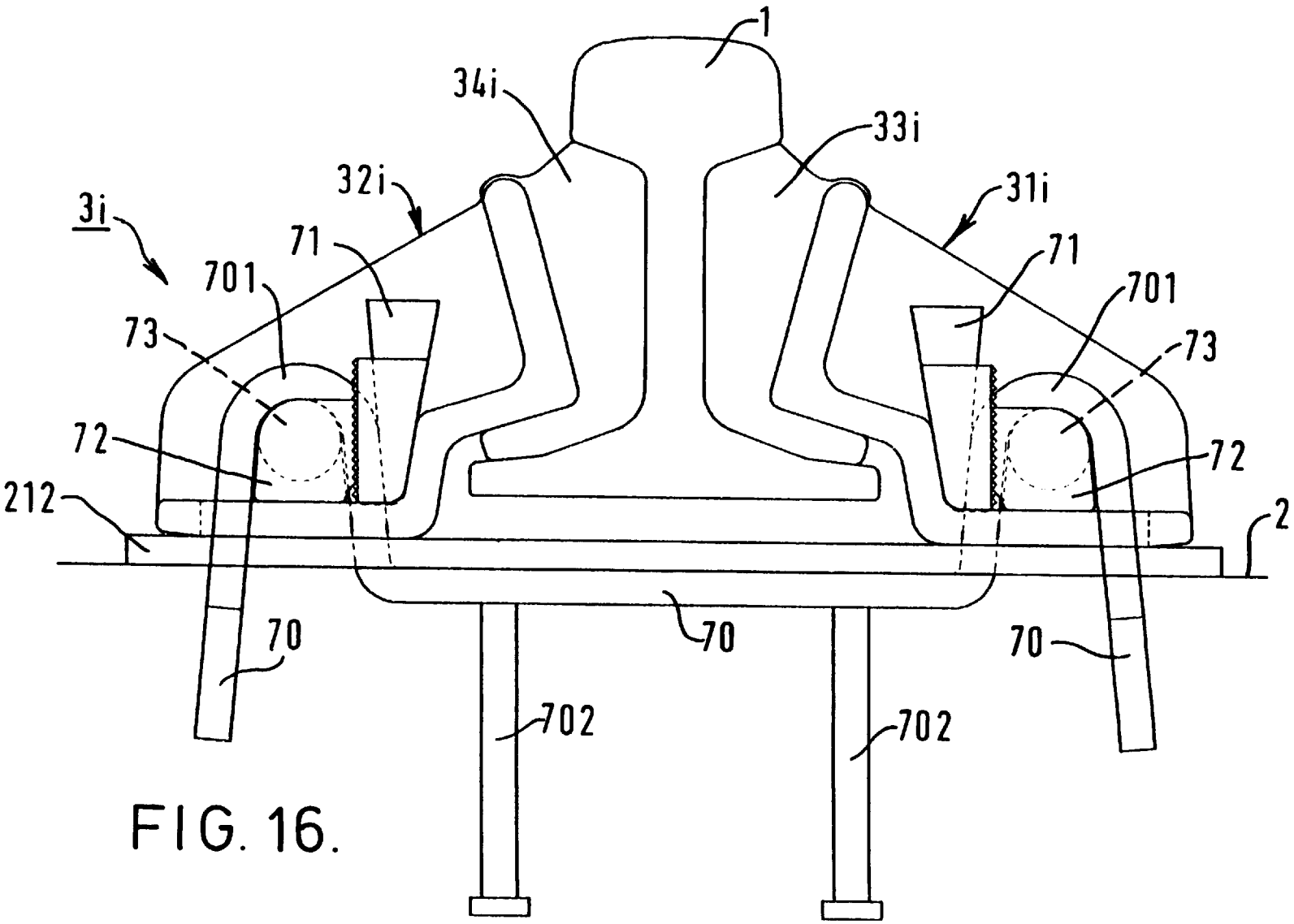
FIG. 16 shows an end view of a second modification of the ninth embodiment of FIGS. 11 and 12.

FIG. 16 shows a further modification of the ninth embodiment. This modification is used to adjust the height of the assembly to compensate for rail head wear.

A shim 212 of an appropriate thickness is located between the assembly 3*i* and the track foundation 2 in order to adjust the height of the rail head. The size of the components 72 must be reduced in correspondence with the resulting reduction in size of the aperture defined by the portion 701. Accordingly, a number of differently-sized components 72 must be provided to allow varying adjustments in height to be obtained.

Figure 17:
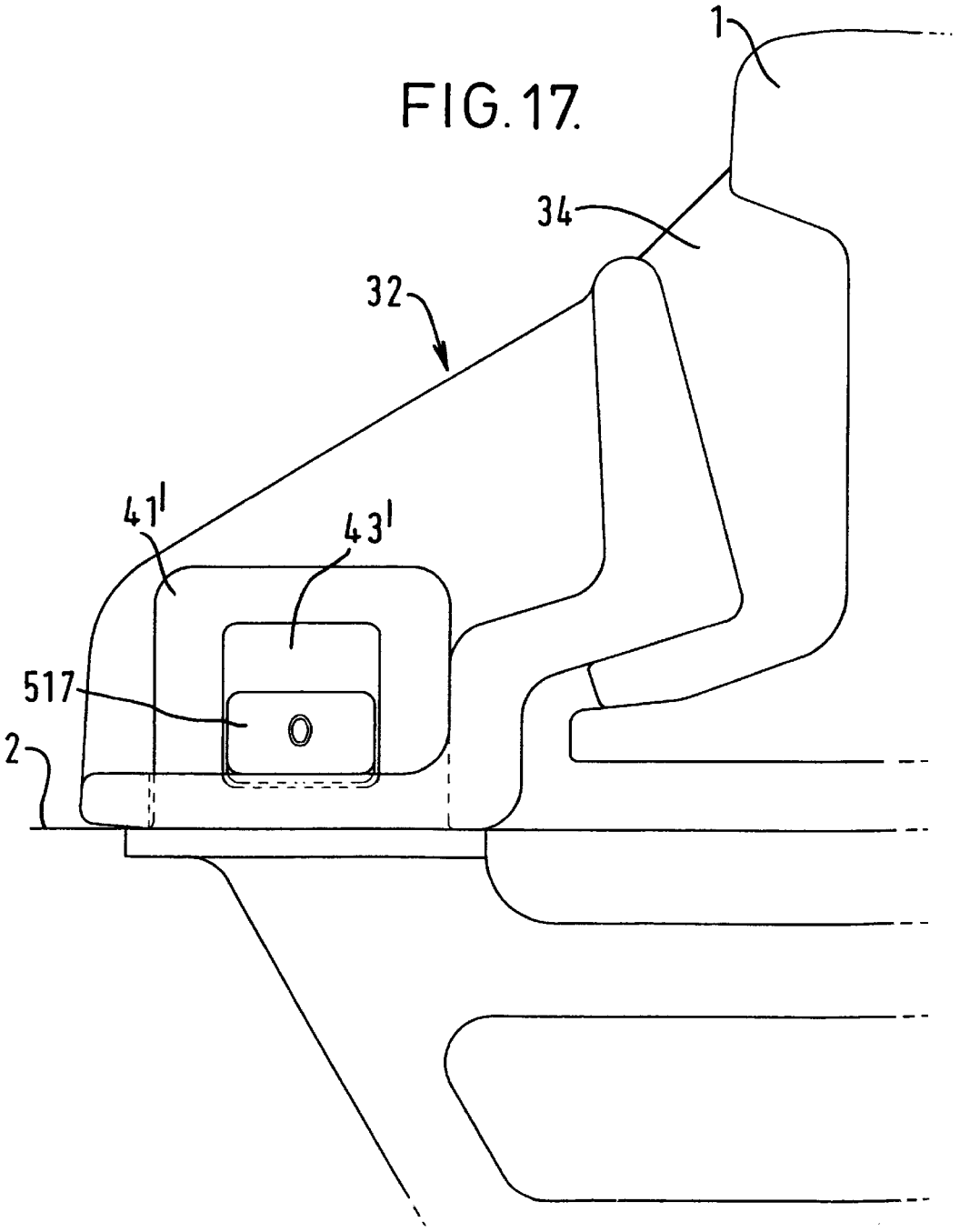
FIG. 17 shows a part view of an embodiment similar to those shown in FIGS. 2 to 6.

FIG. 17 shows a modification of the second to fifth embodiments described with reference to FIGS. 2 to 6. This modification is used to adjust the height of the rail for those embodiments. Such height adjustment is achieved by using adjustment wedges 517 inserted under the clip 51 (not shown). The clip 51 is inserted into a shoulder 41' which has a larger aperture 43' therethrough than the previously described shoulder 41. In this way, the overall height of the assembly can be adjusted. Shims are inserted between the assembly and the track foundation, as before.

Figure 18:
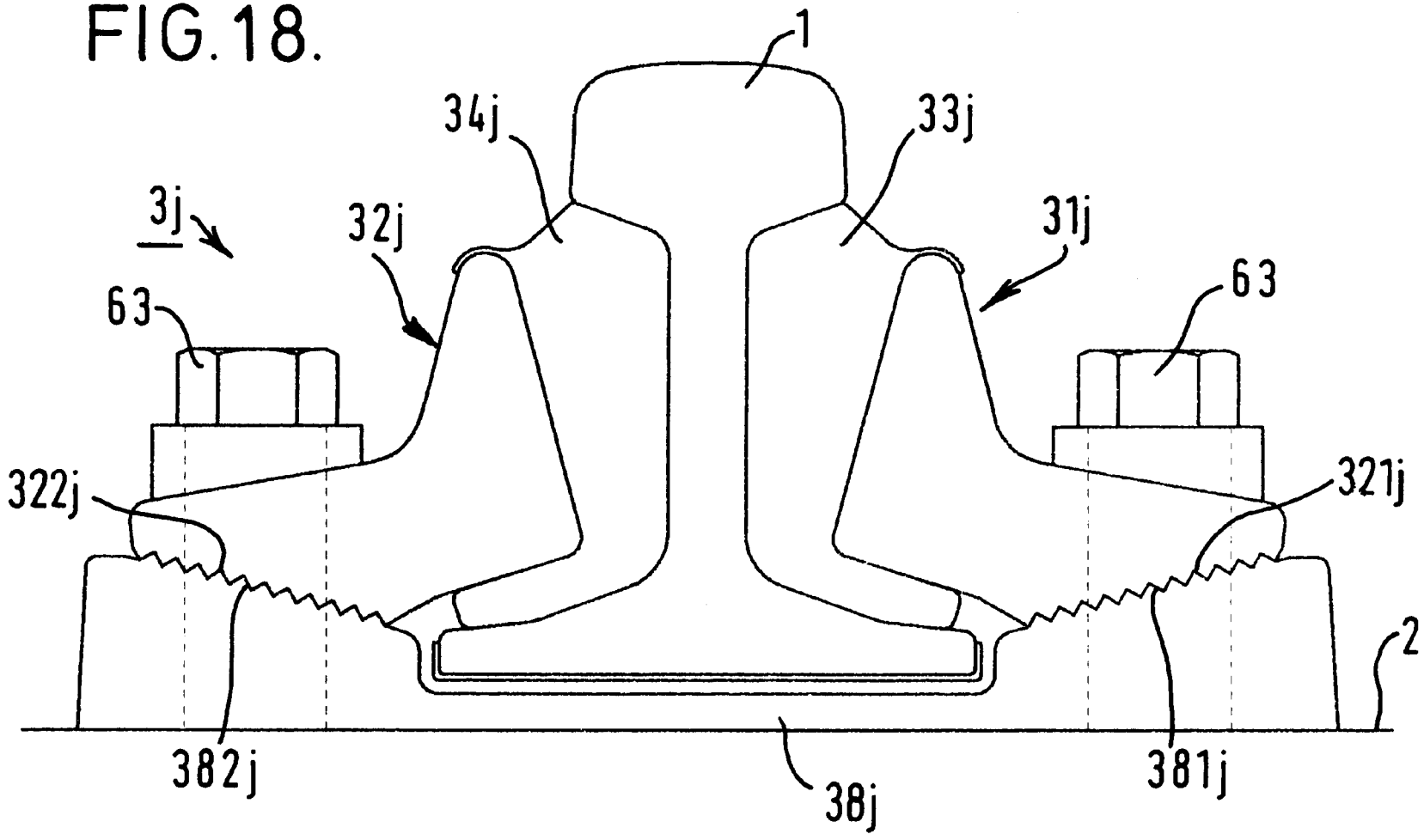
FIG. 18 shows an end view of a tenth embodiment of the present invention.

FIG. 18 shows an end view of a tenth embodiment of the present invention. As in the previous embodiments described above, a rail 1 is held in place on a track foundation 2 by means of an assembly 3*j*. This assembly 3*j* comprises a first bracket 31*j*, a second bracket 32*j*, and first and second elastomeric members 33*j* and 34*j*. The first and second brackets are located on respective upper faces of a base plate 38*j*, to opposite respective sides of the rail 1.

The tenth embodiment of the present invention illustrates another way in which the required clamping load may be applied to the elastomeric members 33*j* and 34*j*. This clamping load is applied when the brackets are located correctly on the baseplate 38*j*. In order to position these brackets correctly, the assembly, including the brackets 31*j* and 32*j*, the elastomeric members 33*j* and 34*j* and rail, are compressed using a compression tool (not shown). The assembly is then placed on the baseplate 38*j* in such a way that lower serrated surfaces 321*j*, 322*j* of the brackets 31*j* and 32*j* engage with corresponding serrated top surfaces 381*j*, 382*j* of the baseplate 38*j*. In addition, the upper surfaces 381*j*, 382*j* of the baseplate 38*j* slope inwardly towards the rail and the lower faces 321*j*, 322*j* of the brackets 31*j* and 32*j* are correspondingly inclined.

When the compression tool is released the clamping load is transferred from the elastomeric members 33*j*, 34*j*, through the brackets 31*j* and 32*j*, to the baseplate 38*j* by virtue of the engagement of the serrated edges of the base plate 38*j* and the brackets 31*j* and 32*j*. The brackets and the base plate are held down onto the track foundation 2 by means of bolts 63. The transfer of clamping load to the baseplate means that the bolts 63 are relatively unstressed, thereby reducing any likelihood of a bolt failure.

Figure 19:
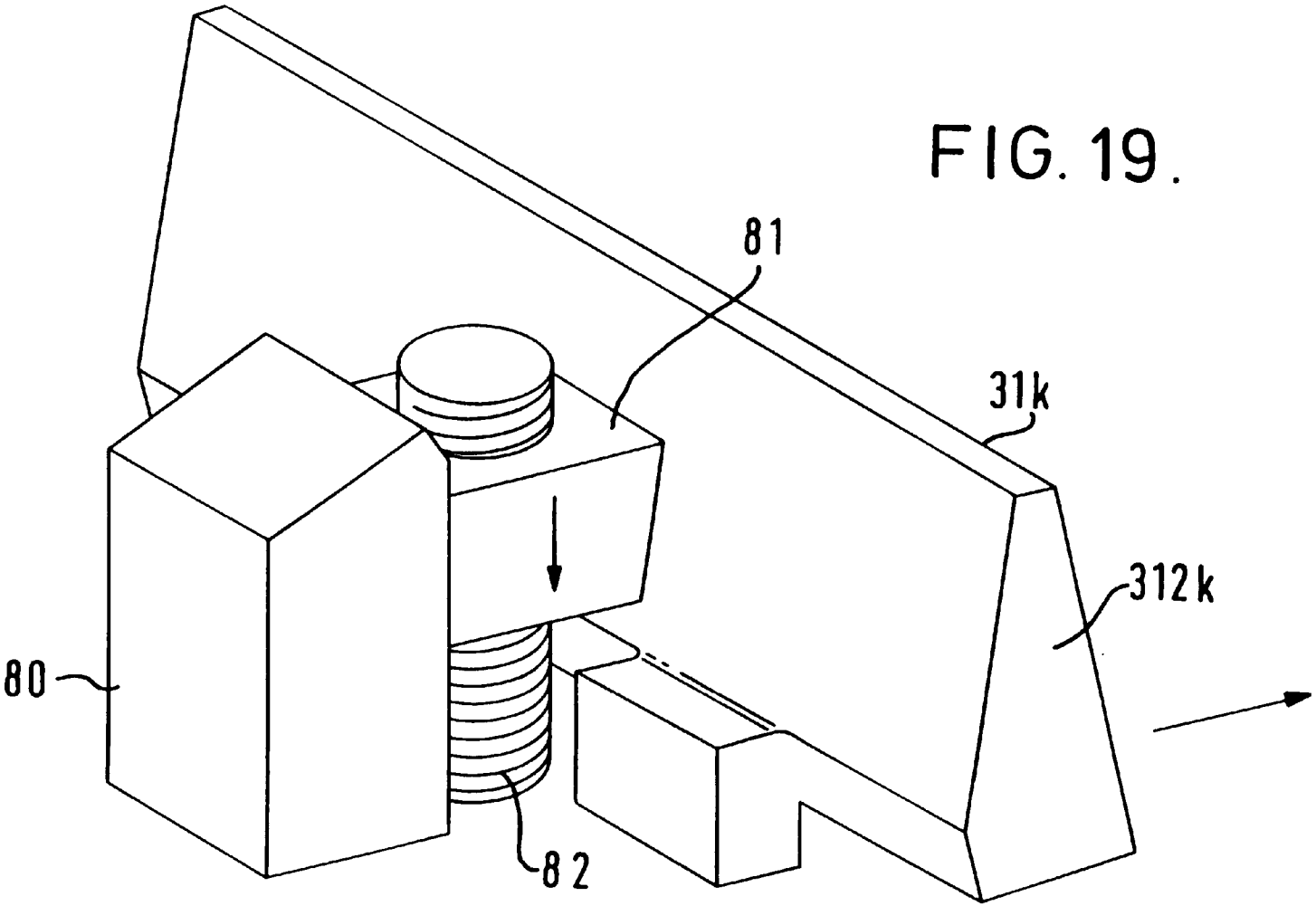
FIG. 19 shows a perspective view of parts of an eleventh embodiment of the present invention.

FIG. 19 shows some parts of an eleventh embodiment of the present invention. In FIG. 19 only one bracket 31*k* is shown for the sake of simplicity. As in all of the other embodiments, a second bracket is used on the opposite side of the rail, and elastomeric members are located between the rail and the brackets.

In FIG. 19 a wedge-shaped piece provides lateral adjustment and is combined with a fastening, in this case a threaded arrangement which attaches the assembly to the track foundation. In addition to providing a lateral clamping load to the elastomeric members, such an assembly can ensure that the side brackets are rigidly held in place, so the vibration-reducing characteristics of the assembly are not reduced.

In FIG. 19, the track foundation (not shown) includes an upstand 80, which is rigidly attached to the foundation 2. The bracket 31*k* is shaped as shown in FIG. 19 and includes a bearing surface 312*k* which carries an elastomeric member in a manner similar to that described with reference to the other embodiments.

An assembly using the bracket 31*k* is installed at the track site by placing the brackets in position on the track foundation (not shown) with the uncompressed elastomeric members (not shown) and the rail (not shown) between them. A wedge member 81 is then inserted between the upstand member 80 and the bracket 31*k*, so that the bracket 31*k* is held in place. Securing means 82, a stud in FIG. 19, are used to secure this wedge portion 81 in place. The upright part 312*k* of the bracket 31*k* is sloped so as to engage with the wedge member 81. As the securing means 82 are tightened, forcing the wedge 81 downwardly, the necessary clamping load is applied to the elastomeric members in the assembly. Alternatively, the brackets and elastomeric members could be compressed, using a clamping tool (not shown), against the rail before the securing means 82 are tightened. Such precompression means that less torque is required to tighten the securing means 82.

The securing means 82 could alternatively be formed by a bolt which locates in a threaded hole in the track foundation 2, or a threaded sleeve which projects from the track foundation. The securing means only experience tensile loading, since the hole through which they pass in the wedge member 81 is oversized, so that no lateral loading is applied to the securing means 82.

The wedge member can be shaped in plan view so that it can engage with channels or grooves (not shown) in the side brackets or upstand. Such shaping would serve to resist longitudinal movement of the wedge member.

The required clamping load is applied to the elastomeric members of the assembly by means of the wedge members and is adjustable by virtue of the shape of the wedge members.

Figure 20:
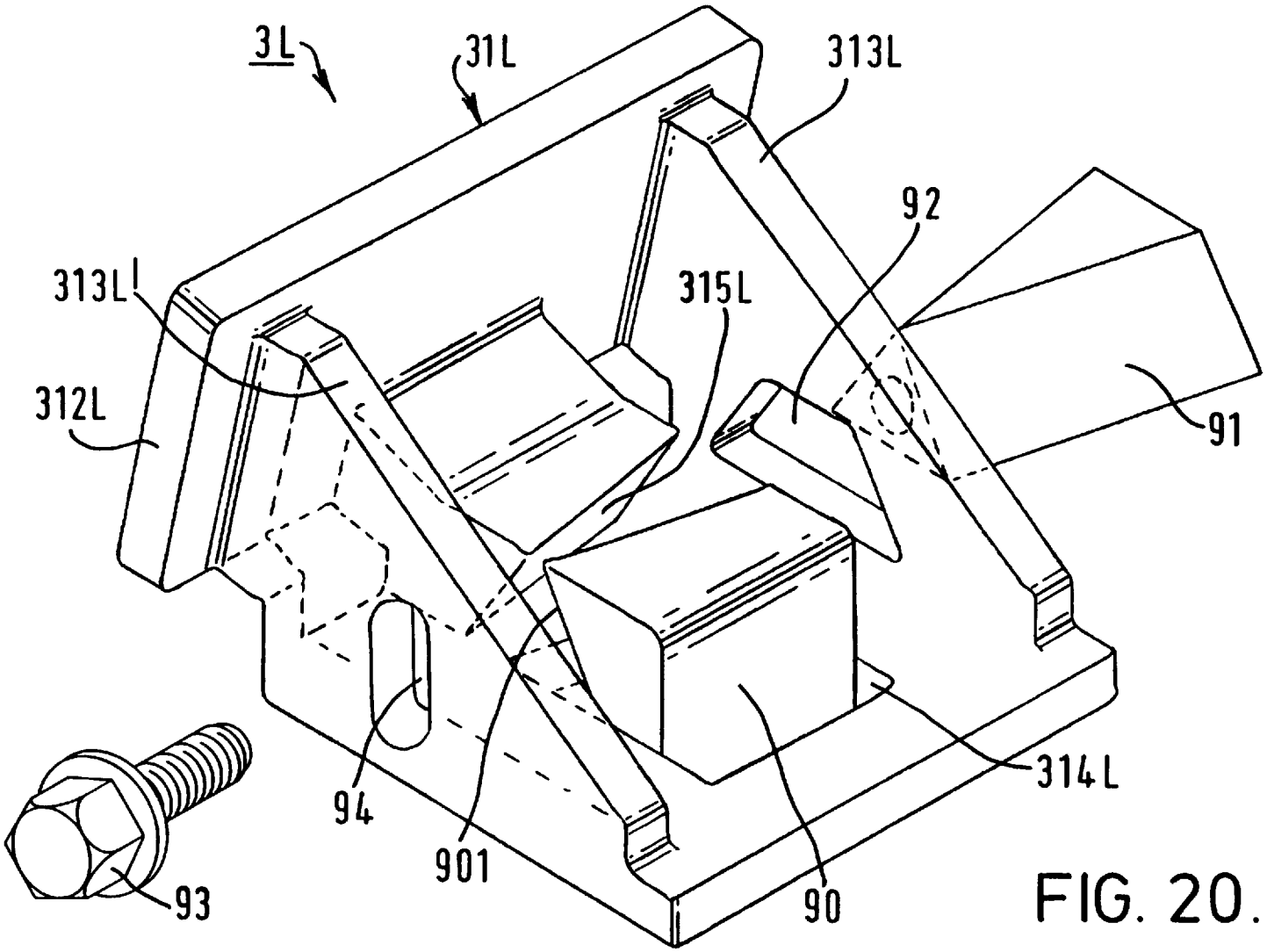
FIG. 20 shows a perspective view of parts of a twelfth embodiment of the present invention.

FIG. 20 shows a twelfth embodiment of the present invention, and shows only one bracket of an assembly 3L for the sake of simplicity. Two such brackets are used in a support assembly, as in previous embodiments.

The bracket 31L is used to support an elastomeric member against the side of a rail (not shown) in a manner similar to that described with reference to the other embodiments. The track foundation (not shown) is provided with an upstand 90, which has a correspondingly inclined surface 901.

To install the assembly 3L on a track foundation, a bracket is placed on either side of a rail, and an elastomeric member placed between a bracket and the rail. The upstand 90 is positioned through an aperture 314L provided in the base portion of the bracket 31L, as shown in the drawing. Upright part 312L has a projection which extends towards the upstand 90 and has an inclined surface 315L confronting the surface 901, and into the space defined therebetween there is inserted, through an opening 92 in the side of a web 313L of the bracket 31L, a wedge member 91. This wedge member 91 has inclined surfaces corresponding to the inclined surfaces 315L and 901 respectively, and is used to force the bracket and the upstand apart, thereby applying the necessary clamping load to the elastomeric members (not shown). Alternatively, the assembly may be compressed by a tool as before, and then the wedge member 91 locked in place.

The wedge member 91 is held in place using a bolt 93 inserted through an aperture 94 in an opposing web 313L' of the bracket 31L. The twelfth embodiment of the present invention thus provides a relatively simple method of applying the clamping load to the elastomeric members, and also of holding the brackets on the track foundation.

Height adjustment of the assembly of the twelfth embodiment may be easily achieved by the use of shims placed between the assembly and the track foundation. The shape of the wedge member 91 and the hole 94 allow this easy adjustment of height.

Where a wedge type fastening is used, it is preferable to employ a locking mechanism so that the wedge does not become loose, thereby lowering the clamping load applied to the elastomeric members. Examples of such locking mechanisms are shown in FIGS. 11 to 15, 19 and 20.

Figure 21A:
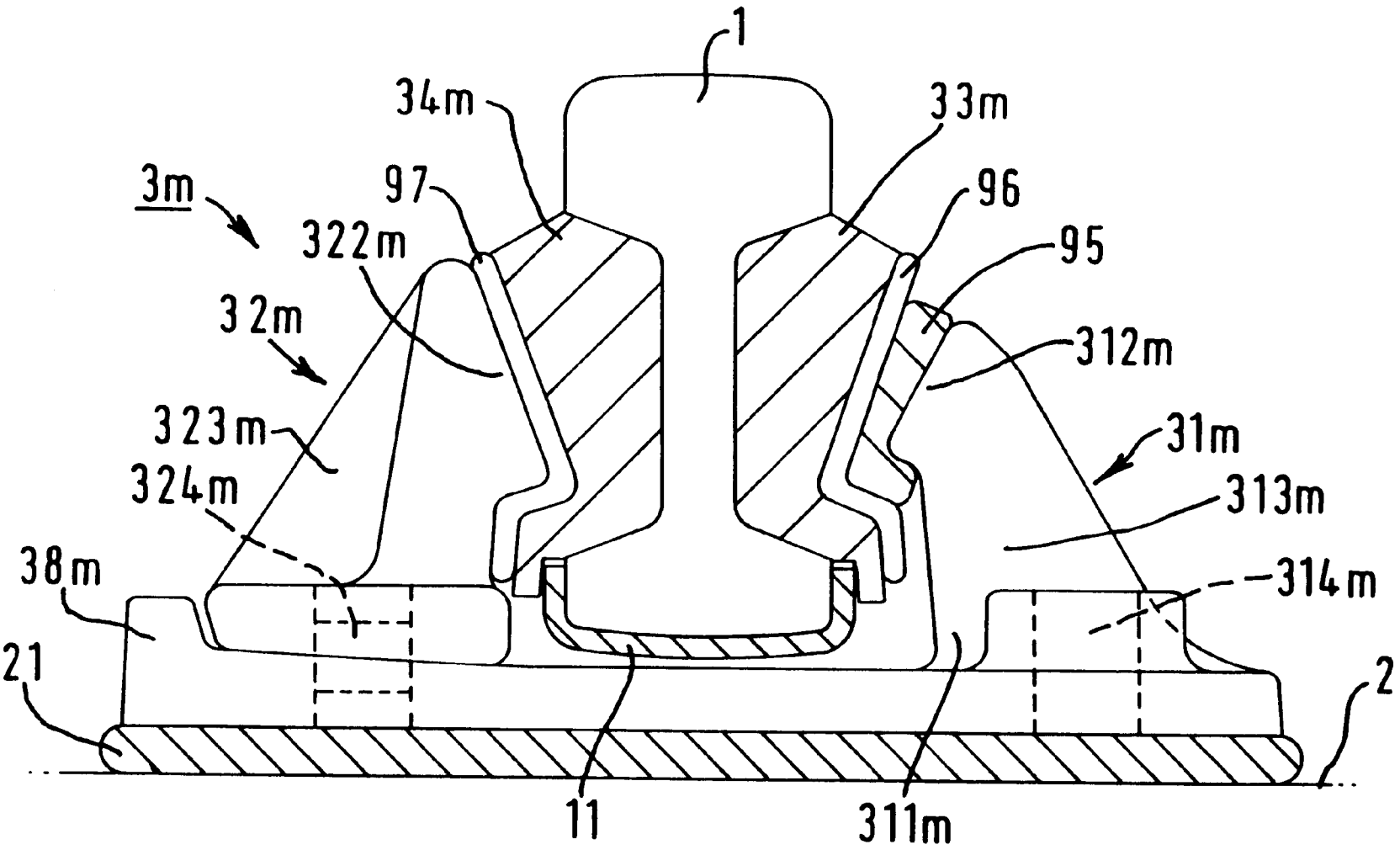
FIGS. 21A and 21B show respective end views of a thirteenth embodiment of the present invention and a modification thereof.

FIG. 21A shows a thirteenth embodiment of the present invention, which is similar to the embodiment described with reference to FIG. 10.

In common with the embodiment shown in FIG. 10, the thirteenth embodiment has a first bracket 31*m* having an extended base portion 38*m*, on which a second bracket 32*m* is mounted. In contrast to the FIG. 10 embodiment the thirteenth embodiment includes a rigid wedge member 95 which is located between a first elastomeric member 33*m* and the first bracket 31*m*.

Each side of the assembly has a plate member, 96 or 97, attached to the corresponding elastomeric member 33*m* or 34*m*. The upper part of the first bracket 31*m* is shaped so as to engage with the wedge member 95, when the assembly is in use. The plate 96 allows the wedge 95 to be driven in between the first bracket and the first elastomeric member 33*m*, without displacing that elastomeric member 33*m*. The wedge member 95 is shaped so as to locate positively around the first bracket 31*m*.

Figure 21B:
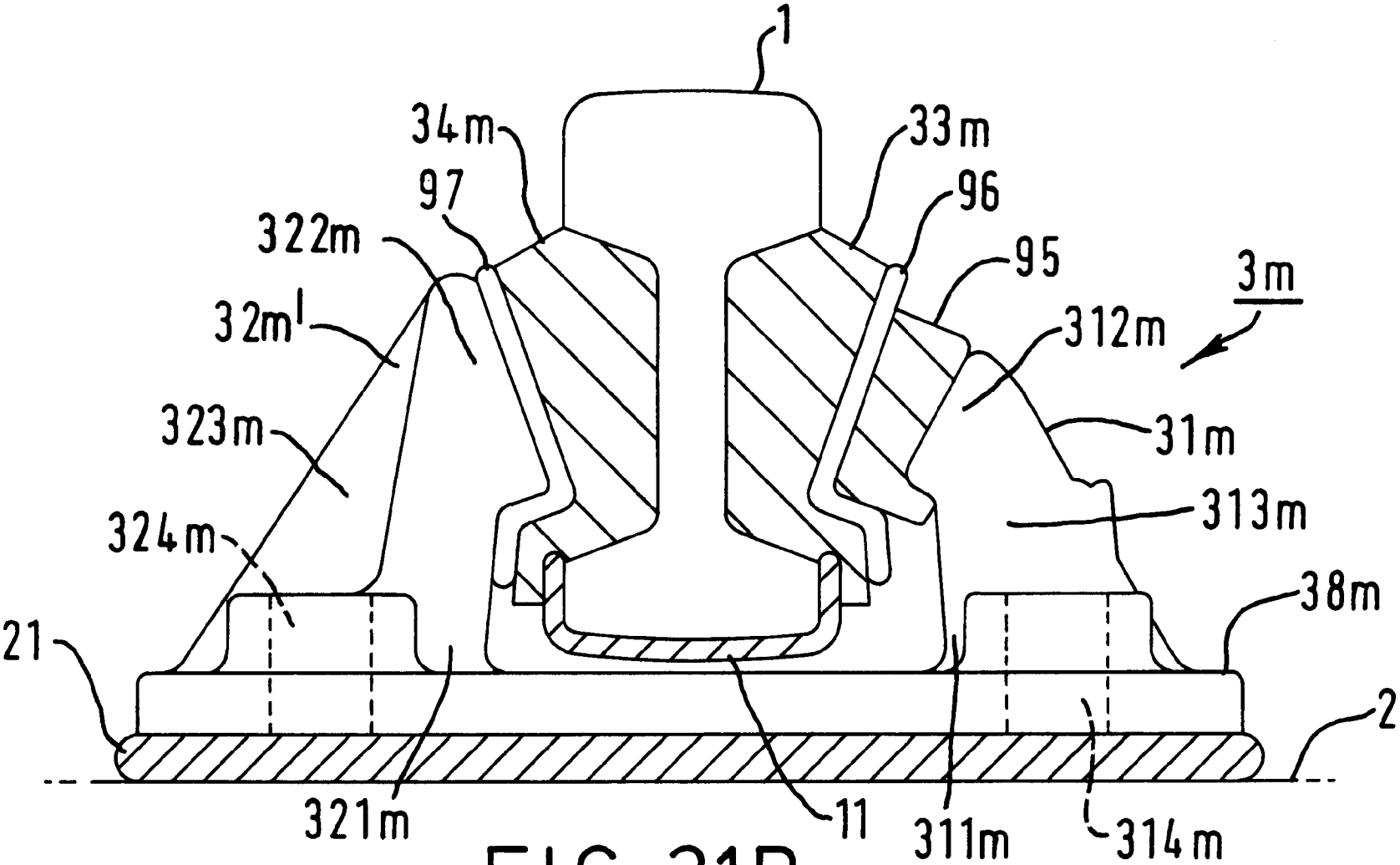

FIG. 21B shows a modification of the embodiment shown in FIG. 21A. In the assembly shown in FIG. 21B, a second bracket 32*m*' is integrally formed with the base plate 38*m*. In other respects the assembly of FIG. 21B is identical to the FIG. 21A assembly. The assembly of FIG. 21B offers the advantage of a lower number of loose components making up the assembly.

In the assemblies shown in FIGS. 21A and 21B, the clamping load is maintained by the fit of the components and the use of wedge members. The use of wedge members also has the advantage that the assembly components can be lowered onto the track foundation in an uncompressed state, the clamping load being generated by the insertion of the wedge member 95.

Figure 22A:
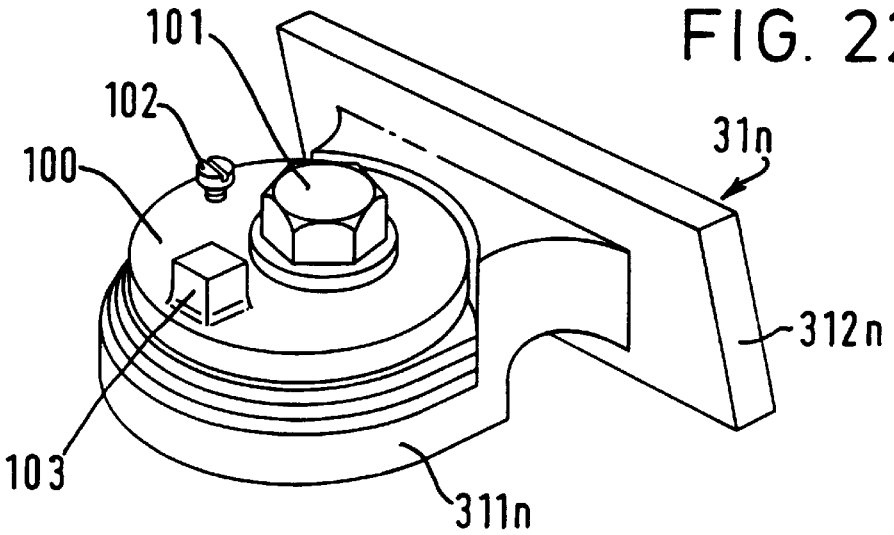
FIGS. 22A to 22C show perspective views of parts of a fourteenth embodiment of the present invention and modifications thereof.
Figure 22B:
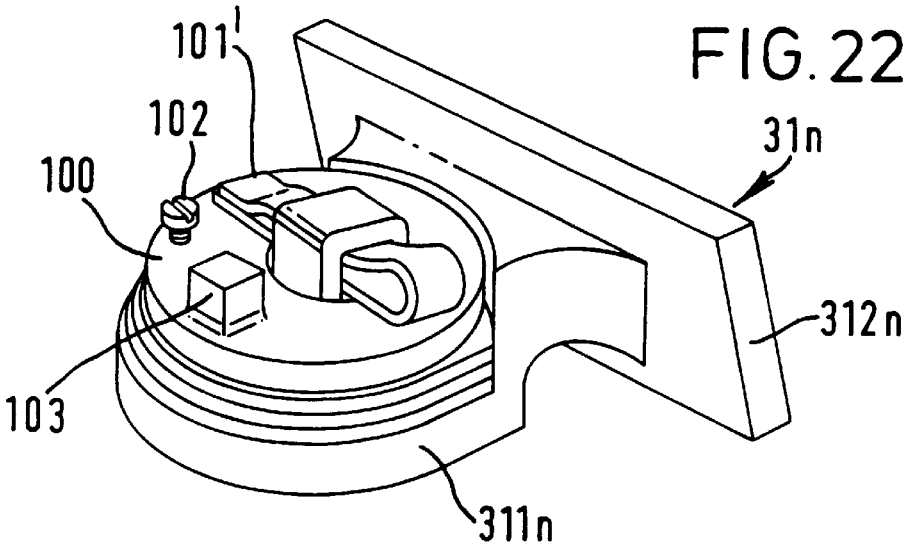
Figure 22C:
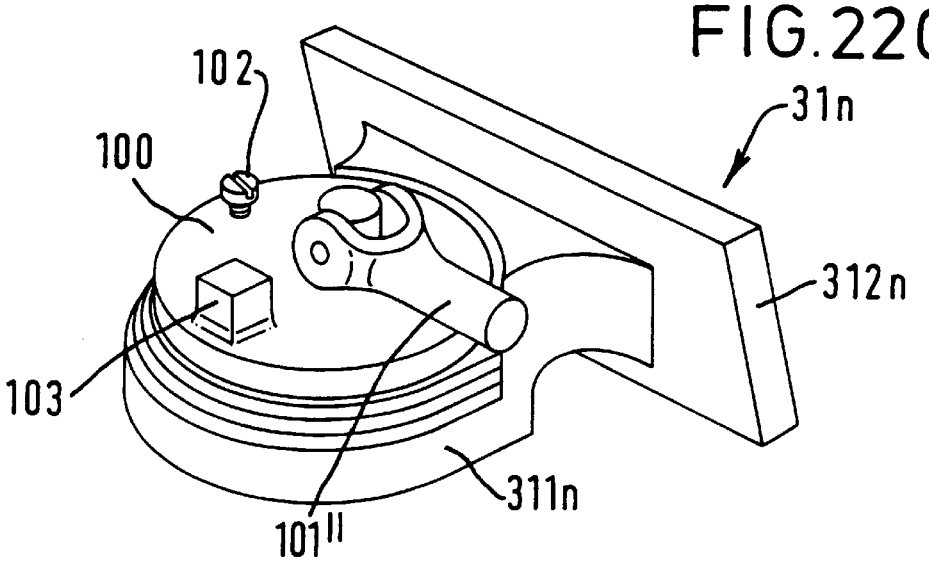

FIGS. 22A to 22C show three further methods of applying the clamping load to the brackets in an embodiment of the present invention. Only one bracket 31*n* having an upright part 312*n* is again shown for the sake of simplicity.

All three methods use an eccentric cam 100, which acts as rotating wedge to adjust the position of a bracket 31*n* in relation to the track foundation (not shown). Fixing means 101 (101', 101") are used to hold the assembly down on to the track foundation.

The eccentric cam 100 can be rotated about the fixing means 101 (101', 101") so that the lateral position of the bracket 31*n* can be adjusted.

In use, two brackets, as before, are compressed against respective elastomeric members, in order to provide the necessary clamping load to those elastomeric members, by a compression tool. An upstand 103, or alternatively a socket (not shown), provided on the eccentric cam 100 is used for locating the tool. The eccentric cam 100 is then rotated and a locking screw 102 tightened so that the clamping load is maintained when the compression tool is removed. The locking screw 102 screws into one of a series of threaded holes in the base 311*n* of the side bracket. Such a locking screw is required because the fixing means 101 (101', 101") would not be able to provide a secure means of preventing the cam rotating and releasing the clamping load. For this reason, the eccentric cam embodiments shown in FIGS. 22A to 22C may not be as effective as the previously described embodiments, and may be more suited to low clamping load arrangements.

Vertical adjustment of the assembly can be provided by the use of shims placed above or below the side brackets.

FIG. 22A shows an eccentric cam 100 held down by a bolt arrangement 101. FIG. 22B shows an eccentric cam 100 held down by a clip arrangement 101', for example a clip described previously with reference to FIG. 5, and FIG. 22C shows an eccentric cam 100 held down by a toggle clamp 101".

Figure 23:
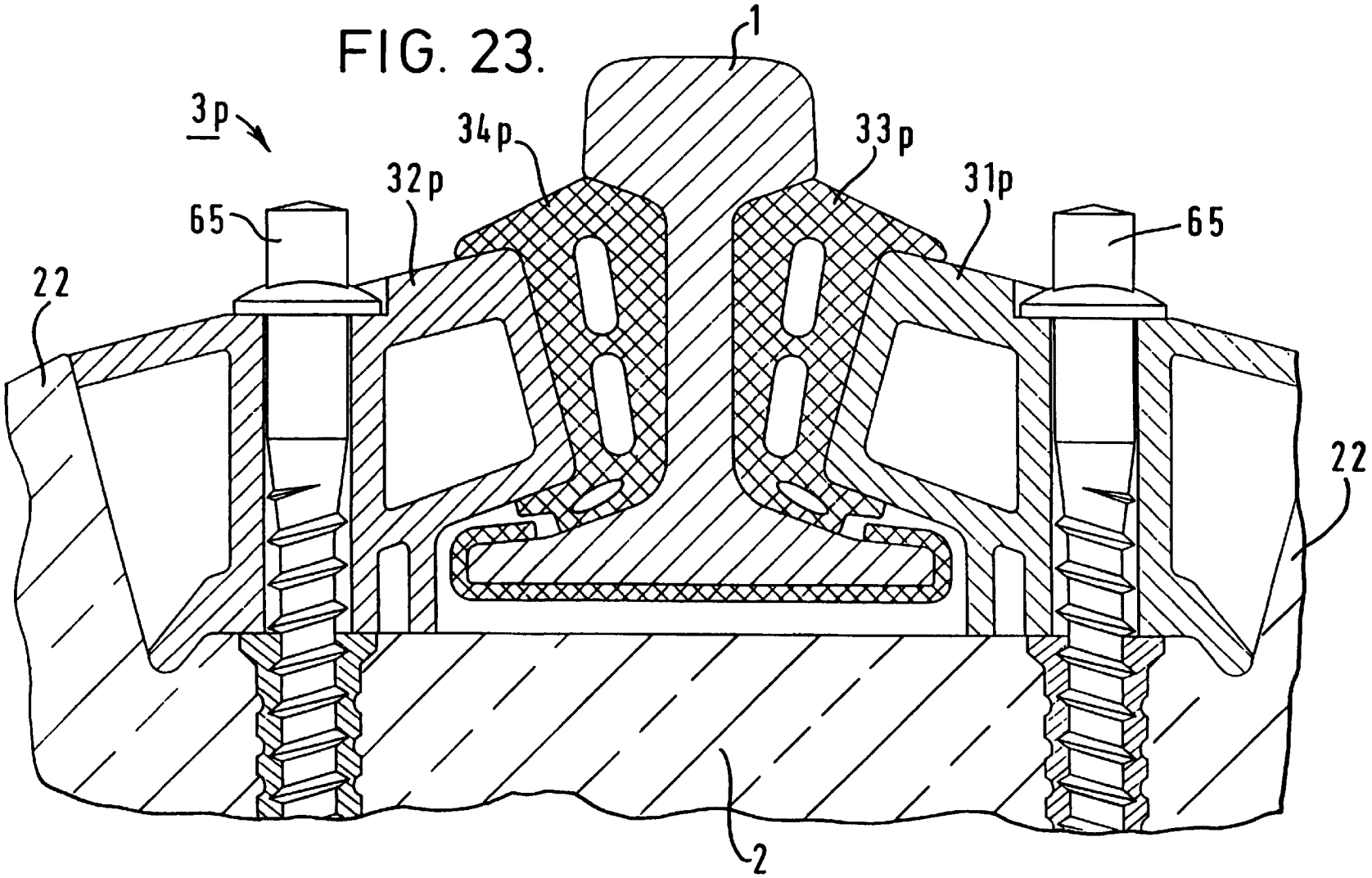
FIG. 23 shows an end cross sectional view of a fifteenth embodiment of the present invention.

FIG. 23 shows a fifteenth embodiment of the present invention, in the assembly 3*p* of which a rail 1 is supported by elastomeric members 33*p* and 34*p* held in place by brackets 31*p* and 32*p*. The whole assembly is located in a trough defined by upstands 22 of the track foundation 2. The brackets provide the necessary clamping load by their location in the trough. The brackets 31*p* and 32*p* are held onto the track foundation by means of bolts 65 located through holes in the first and second brackets 31*p* and 32*p* respectively.

Such an embodiment provides the required clamping load by means of the fit of the assembly, and is shown and described to illustrate that the required level of clamping load could be provided by such a trough assembly. However, there are drawbacks associated with the installation and maintenance of such an assembly, even though the assembly shown in FIG. 23 is a discrete assembly. In some circumstances, for example in street running systems where the rail and fastening must be concealed beneath a cobbled or asphalt road surface, there may be little advantage in fixing the assembly to a flush surface rather than in a trough. However, there may still be benefits in supporting the rail at discrete intervals with an applied clamping load, rather than continuously.

In most cases the brackets in each assembly have been shown as both being independently adjustable in lateral location. This allows small adjustments in track gauge to be made, and also allows the clamping load to be varied or adjusted independently. However, it should also be noted that all the afore-mentioned embodiments may also be arranged so that this lateral adjustment is provided on only one side of the assembly. This allows the clamming load to be varied or adjusted, but not the track gauge.

Further still, assemblies embodying the present invention may include side brackets which are rigidly attached to one another, in which case the required clamping load is provided by the fit of the assembly, and is thus dependent on the tolerances in the assembly.

What is claimed is:

1. A support assembly (3) for a railway rail (1) having along its length a head and a web integral with said head and depending downwardly from said head, said support assembly comprising respective pluralities of rail supporting means (31, 32, 33, 34) disposed at mutually opposed locations on both sides of said rail for resiliently suspending said rail above a track foundation (2) underlying said rail, said plurality of supporting means on each side of said rail being spaced from one another longitudinally of said rail and engaging said rail at discrete locations along the rail, said mutually opposed supporting means being constructed for applying a force to said rail at each of said discrete locations such that a transverse component of said force is applied to said web of said rail and that an upward component of said force supporting the weight of said rail is applied to the underside of said head of said rail, and said supporting means further including fixing means (41, 51/52; 53*h*, 60; 701, 71/72; 63; 80, 82; 90, 91; 100, 101) establishing positions of said mutually opposed supporting means relative to one another whereby to enable said supporting means to exert on the opposite sides of said rail at each of said discrete locations a predetermined clamping load for imparting to said support assembly a desired resistance to longitudinal creep of said rail through said support assembly, wherein said mutually opposed rail supporting means comprise first and second brackets (31, 32) and first and second elastic members (33, 34), each of said first and second brackets having a bearing part (312, 322) and a base part (311, 321), said bearing part of each of said first and second brackets being located adjacent to one or the other side of said rail (1) when said support assembly (3) is in use and said base part of each of said first and second brackets being located on an upper surface of said track foundation (2), each said first elastic member (33) being located between a respective said first bracket (31) and said rail and each said second elastic member (34) being located between said rail (1) and a respective said second bracket (32), when said support assembly is in use, and said mutually opposed rail supporting means further comprising means (41, 51, 517; 53, 60; 701, 71, 72, 73; 701, 71, 72, 74; 41*f*, 52; 311*j*, 321*j*, 381*j*, 382*j*; 80 to 82; 90 to 94; 100 to 103;) for maintaining said predetermined clamping load, and wherein said first and second brackets (31, 32) are held in place on said track foundation (2) by said fixing means, at least part of which are located within the confines of respective recesses provided therefor in respective ones of said base parts (311, 321) of said first and second brackets.

2. An assembly as claimed in claim 1, wherein said rail supporting means, when said support assembly (3) is in use, are attached to an approximately horizontal upper surface of said track foundation.

3. An assembly as claimed in claim 1, wherein said first and second brackets (31, 32) are supported on a base plate (38).

4. An assembly as claimed in claim 3, wherein said base plate (311*h*) is integral with one of said brackets (31*h*).

5. An assembly as claimed in claim 4, wherein said base part (321*h*) of the other one of said first and second brackets (31, 32) has an inclined lower surface, and said base plate (38) has a corresponding inclined upper surface.

6. An assembly as claimed in claim 3, wherein said base plate (38) is integral with both of said first and second brackets (31, 32).

7. An assembly as claimed in claim 3, wherein said base part (311, 321) of each of said first and second brackets (31, 32) has an inclined lower surface (311*j*, 321*j*), and upper surfaces (381*j*, 382*j*) of said base plate (38) are correspondingly inclined.

8. An assembly as claimed in claim 1, wherein said track foundation (2) has an upstand (80; 90), said assembly (3) further comprising a wedge element (81; 91) shaped such that it fits between said upstand (80; 90) and said bearing part (312, 322) of an adjacent one of the said brackets (31, 32) when said assembly (3) is in use so as to maintain a desired clamping load applied to said bracket (31, 32).

9. An assembly as claimed in claim 3, wherein said base plate (38) has an upstand (80; 90), said assembly (3) further comprising a wedge element (81; 91) shaped such that it fits between the upstand (80; 90) and said bearing part (312, 322) of an adjacent one of said brackets (31, 32) when said assembly (3) is in use so as to maintain a desired clamping load applied to said bracket (31, 32).

10. An assembly as claimed in claim 8 or 9, wherein said base part (311, 321) of said bracket (31, 32) is provided with a slot (314L) therethrough through which said upstand (90) protrudes.

11. An assembly as claimed in claim 10, wherein the fit of said upstand (90) in said slot (314L) allows movement of said bracket (31, 32) relative to said upstand (90) such that insertion of said wedge element (91) between said upstand (90) and said bearing part (312, 322) of said adjacent bracket (31, 32) drives said adjacent bracket (31, 32) away from said upstand (90) whereby said desired clamping load is applied to said bracket (31, 32).

12. An assembly as claimed in claim 8 or 9, wherein said bearing part (312, 322) of said adjacent bracket (31, 32) has a projection (315L) extending towards said upstand (90) so as to define a space between opposing surfaces of said projection (315L) and upstand (90) for receiving said wedge element (91).

13. An assembly as claimed in claim 8 or 9, arranged such that said wedge element (81) may be installed substantially vertically.

14. An assembly as claimed in claim 8 or 9, arranged such that said wedge element (91) may be installed substantially horizontally.

15. An assembly as claimed in claim 8 or 9, wherein, when said assembly (3) is in use, said wedge element (81; 91), or at least one of said wedge elements (71, 72), is secured by means of a fastening device (73; 82; 93).

16. An assembly as claimed in claim 1, wherein part of said fixing means (41, 51; 53, 60; 701; 63; 82; 90; 101) projects above said base part (311, 321) of said bracket (31, 32) such that between such projecting part and said bracket (31, 32) there is defined an aperture for receiving cooperating first and second wedge elements (71, 72) shaped so as to maintain a desired clamping load applied to said bracket (31, 32).

17. An assembly as claimed in claim 16, wherein each of said first and second wedge elements (71, 72) has a serrated face (711, 712; 722), which serrated faces (711, 712; 722) interlock when said assembly (3) is in use.

18. An assembly as claimed in claim 1, wherein said first and second brackets (31*a*, 32*a*) are of identical cross section, and said first and second elastic members (33*a*, 34*a*) are of identical cross section, so that the supported rail (1) is held in a substantially upright condition.

19. An assembly as claimed in claim 1, wherein said first and second brackets (31*c*, 32*c*) have non-identical cross sections, and said first and second elastic members (33*c*, 34*c*) have identical cross sections, thereby supporting the rail (1) in an inclined condition with respect to the vertical axis.

20. An assembly as claimed in claim 1, wherein said first and second brackets (31*d*, 32*d*) have identical cross sections, and the said first and second elastic members (33*d*, 34*d*) have non-identical cross sections, thereby supporting the rail (1) in an inclined condition with respect to the vertical axis.

21. An assembly as claimed in claim 1, wherein each of said first and second brackets (31*e*, 32*e*) and/or each of said first and second elastic members (33*e*, 34*e*) is shaped such that said stiffness of said assembly (3) varies, in a direction parallel to the longitudinal axis of the rail (1), such that it is greatest in the central region of said assembly (3).

22. An assembly as claimed in claim 1, wherein each of said first and second brackets (31*g*, 32*g*) and/or each of said first and second elastic members (33*g*, 34*g*) is shaped so as to augment the applied clamping load.

23. An assembly as claimed in claim 1, wherein said height of the rail (1) relative to said track foundation (2) is adjustable.

24. An assembly as claimed in claim 1, wherein there is a support plate (96, 97) located between said first and/or second bracket (31*m*, 32*m*) and said elastic member (33*m*, 34*m*) associated with or each bracket (31*m*, 32*m*).

25. An assembly as claimed in claim 21, wherein there is a rigid member (95) located between one of said support plates (96, 97) and said bracket (31, 32) associated with that support plate (96, 97).

26. An assembly as claimed in claim 1, wherein said clamping load maintaining means comprise eccentric cam means (100 to 103).

27. An assembly as claimed in claim 1, wherein said first and second brackets (31, 32) are hinged relative to said track foundation (2).

28. An assembly as claimed in claim 1, wherein the said fixing means (41, 51; 53, 60; 701; 63; 82; 90; 101) comprise a shoulder (41; 41*f*) and securing clip (51; 52; 101').

29. An assembly as claimed in claim 28, wherein said securing clip (51; 52; 101') is held in place in said shoulder (41; 41*f*) by the resilience of that securing clip (51; 52; 101'), and wherein said securing clip (51; 52; 101') is substantially rigid in a vertical direction when said assembly (3) is in use.

30. An assembly as claimed in claim 28, wherein said securing clip (51; 52; 101') comprises a front part (510, 511, 514, 515, 516) which is inserted into said shoulder (41; 41*f*) when said assembly (3) is in use, and a rear part (512, 513) to which force is applied in order to insert said front part (510, 511, 514, 515, 516) into said shoulder (41; 41*f*), said front part (510, 511, 514, 515, 516) having means (514) for retaining said clip (51; 52; 101') in said shoulder (41; 41*f*) when said assembly (3) is in use.

31. An assembly as claimed in claim 30, wherein said front part (510, 511, 514, 515, 516) comprises a pair of substantially parallel elongate members (511, 514), and said rear part (512, 513) comprises a curved member (512) joining said two elongate members (511, 514), one of said elongate members (511, 514) being shaped so as to provide said means for retaining said clip (51; 52; 101') in said shoulder (41; 41*f*).

32. An assembly as claimed in claim 31, wherein elastic material is located between said pair of substantially parallel elongate members (511, 514) .

33. An assembly as claimed in claim 30, wherein said clip (52) comprises a cylindrical bar of material which is substantially U-shaped in form.

* * * * *

UNITED STATES PATENT AND TRADEMARK OFFICE

CERTIFICATE OF CORRECTION

PATENT NO. : 6,079,631

DATED : June 27, 2000

INVENTOR(S) : Hermann J. Ortwein et al.

It is certified that error appears in the above-identified patent and that said Letters Patent is hereby corrected as shown below:

On the title page, at "[86]", for "PCT/GB95/00510" read --PCT/GB96/00510--.
In column 2, line 55, for "could avoided" read --could be avoided--.
In column 16, line 11, for "clamming" read --clamping--.
In column 18, line 37 (claim 24, line 4), for"with or" read --with said or--.
In column 18, line 38 (claim 25, line 1), for "claim 21" read --claim 24--.

Signed and Sealed this

First Day of May, 2001

Nicholas P. Godici

*Attest:*

NICHOLAS P. GODICI

*Attesting Officer*

*Acting Director of the United States Patent and Trademark Office*